US009988842B2

(12) United States Patent
Moss et al.

(10) Patent No.: US 9,988,842 B2
(45) Date of Patent: Jun. 5, 2018

(54) LADDERS INCLUDING ROPE AND PULLEY SYSTEM AND FALL PROTECTION DEVICE

(71) Applicant: Wing Enterprises, Incorporated, Springville, UT (US)

(72) Inventors: N. Ryan Moss, Mapleton, UT (US); Sean R. Peterson, Santaquin, UT (US); Brian B. Russell, Salt Lake City, UT (US); Gary M. Jonas, Springville, UT (US); Darius S. Penrod, Elberta, UT (US); Bryan Wright, Highland, UT (US)

(73) Assignee: WING ENTERPRISES, INCORPORATED, Springville, UT (US)

( * ) Notice: Subject to any disclaimer, the term of this patent is extended or adjusted under 35 U.S.C. 154(b) by 0 days. days.

(21) Appl. No.: 14/490,496

(22) Filed: Sep. 18, 2014

(65) Prior Publication Data

US 2015/0075907 A1 Mar. 19, 2015

Related U.S. Application Data

(60) Provisional application No. 61/879,506, filed on Sep. 18, 2013.

(51) Int. Cl.
*E06C 7/18* (2006.01)
*E06C 1/36* (2006.01)
(Continued)

(52) U.S. Cl.
CPC ..... *E06C 7/186* (2013.01); *E06C 1/12* (2013.01); *E06C 1/36* (2013.01); *E06C 7/48* (2013.01)

(58) Field of Classification Search
CPC ..... E06C 1/00; E06C 1/12; E06C 1/56; E06C 1/22; E06C 1/30; E06C 1/36; E06C 7/48;
(Continued)

(56) References Cited

U.S. PATENT DOCUMENTS 304,420 A * 9/1884 Fox ..... E06C 1/12 182/213
349,370 A * 9/1886 Springer ..... E06C 1/12 182/108
(Continued)

FOREIGN PATENT DOCUMENTS

CN 2779028 Y 5/2006
CN 2813865 Y 9/2006
(Continued)

OTHER PUBLICATIONS

PCT International Search Report for corresponding PCT International Application No. PCT/US2014/056338, dated Dec. 31, 2014.
(Continued)

*Primary Examiner* — Katherine W Mitchell
*Assistant Examiner* — Shiref M Mekhaeil
(74) *Attorney, Agent, or Firm* — Dorsey & Whitney LLP

(57) ABSTRACT

A ladder is provided which may include a positioning system, a fall arrest system, or both. In one embodiment, a rope and pulley system is provided wherein a first end of the rope is coupled to a base section of the ladder, a second end of the rope is coupled with a fly section of the ladder, and the rope extends between a plurality of pulleys. In one particular embodiment, the rope extends between five different pulleys, two being coupled with the fly section and three being coupled with the base section. At least one portion of the rope may extend along the side of the ladder (e.g., along the side of a rail of the fly section) while another section may extend up the front of the ladder between the rails and in
(Continued)

front of the rungs. A fall arrest mechanism, or an ascender device, may be coupled with the section of rope extending up the ladder between the rails and in front of the rungs.

25 Claims, 16 Drawing Sheets

(51) Int. Cl.
*E06C 7/48* (2006.01)
*E06C 1/12* (2006.01)

(58) Field of Classification Search
CPC ... E06C 7/50; E06C 7/505; E06C 7/18; E06C 7/182; E06C 7/188; E06C 7/488; E06C 7/486; E06C 7/42; E06C 7/186; B66F 11/046; B66C 23/68; B66C 23/82
See application file for complete search history.

(56) References Cited

U.S. PATENT DOCUMENTS 369,084 A * 8/1887 Smith ..... E06C 1/12 182/108
437,395 A * 9/1890 Flynn ..... E06C 1/12 182/212
565,750 A * 8/1896 Hill ..... E06C 1/12 182/213
613,848 A * 11/1898 Seagrave ..... E06C 1/12 182/213
687,945 A * 12/1901 Waggoner ..... E06C 1/12 182/213
802,017 A * 10/1905 Newton ..... E06C 7/06 182/213
1,277,504 A * 9/1918 Tanner ..... E06C 1/12 182/212
2,021,494 A * 11/1935 Zeman ..... E06C 1/22 182/104
2,198,071 A * 4/1940 Artini ..... E06C 1/12 182/103
2,308,175 A * 1/1943 Honig ..... E06C 5/18 182/102
2,310,119 A * 2/1943 Reinhardt ..... E06C 1/30 182/102
2,310,441 A * 2/1943 Klum ..... E06C 1/12 182/213
2,376,875 A * 5/1945 Honig ..... E06C 9/08 182/101
2,439,430 A * 4/1948 Hurd ..... E06C 1/36 182/206
2,961,060 A * 11/1960 Taylor ..... E06C 1/397 182/102
3,331,468 A * 7/1967 Redman ..... E06C 1/12 182/209
3,337,001 A * 8/1967 Huska ..... E06C 1/12 182/207
3,402,788 A * 9/1968 Redman ..... E06C 1/12 182/207
3,565,211 A 2/1971 LeBlanc
3,902,569 A * 9/1975 Bair ..... E06C 1/12 182/211
3,917,189 A 11/1975 Bryll
3,966,018 A * 6/1976 Kozai ..... B66F 11/046 182/103
4,147,231 A 4/1979 Chantler et al.
RE30,072 E * 8/1979 Kleine ..... E06C 7/186 182/5
4,232,761 A * 11/1980 Phillips ..... E06C 1/36 182/195
4,252,214 A * 2/1981 Miller ..... A62B 1/12 182/8
4,440,263 A 4/1984 Smith
4,580,658 A 4/1986 Brda
4,605,100 A * 8/1986 Inglese ..... E06C 7/06 182/211
4,640,387 A * 2/1987 Bocker ..... B66B 9/16 182/213
5,054,581 A 10/1991 Henson
5,117,943 A * 6/1992 Schmitt ..... E06C 7/06 182/213
5,156,240 A 10/1992 Ostrobrod
5,429,207 A 7/1995 Frank et al.
5,582,270 A 12/1996 Fowler
5,850,893 A 12/1998 Hede et al.
5,855,251 A 1/1999 Deuer
5,924,523 A * 7/1999 Krause ..... E06C 1/12 182/207
6,269,908 B1 * 8/2001 Yeamans ..... B63B 27/146 182/196
6,935,464 B2 8/2005 Duan
7,219,766 B2 * 5/2007 Deuer ..... E06C 1/36 182/10
7,600,610 B2 * 10/2009 Deuer ..... A62B 1/06 182/8
8,348,014 B2 1/2013 Kertstetter, Jr.
8,875,839 B1 * 11/2014 Licea ..... A62B 35/005 182/5
8,974,334 B2 * 3/2015 Stephenson ..... B66D 1/7405 182/107
2009/0288913 A1 * 11/2009 Nielsen ..... A62B 1/06 182/8
2010/0300805 A1 * 12/2010 Moss ..... E06C 1/12 182/18
2010/0326768 A1 * 12/2010 Kerstetter, Jr. ..... E06C 7/48 182/5
2011/0073417 A1 3/2011 Chaumontet et al.
2014/0102827 A1 * 4/2014 Russell ..... E06C 7/48 182/107
2014/0202793 A1 * 7/2014 Jonas ..... E06C 7/44 182/108
2015/0075905 A1 * 3/2015 Ballard ..... E06C 1/36 182/107

FOREIGN PATENT DOCUMENTS

EP 2374986 A1 10/2011
GB 21877 0/1910
JP 3133900 U 7/2007

OTHER PUBLICATIONS

Miller, RL20G/20F Mighty Lite, self-retracting lifeline, available as early as May 2007. User Instruction Manual enclosed for reference.
Supplementary European Search Report dated Apr. 12, 2017 for corresponding European Patent Application No. 14846615.4.

* cited by examiner

LADDERS INCLUDING ROPE AND PULLEY SYSTEM AND FALL PROTECTION DEVICE

CROSS-REFERENCE TO RELATED APPLICATIONS

This application claims benefit of U.S. Provisional Patent Application No. 61/879,506, filed Sep. 18, 2013, the disclosure of which is incorporated by reference herein in its entirety.

TECHNICAL FIELD

The present invention relates generally to ladders and, more particularly, to components and features for adjusting ladders and for protecting a user from falling off the ladder, as well as related methods.

BACKGROUND

Ladders are conventionally utilized to provide a user thereof with improved access to elevated locations that might otherwise be inaccessible. Ladders come in many shapes and sizes, such as straight ladders, straight extension ladders, stepladders, and combination step and extension ladders. So-called combination ladders may incorporate, in a single ladder, many of the benefits of multiple ladder designs.

Ladders known as straight ladders or extension ladders are ladders that are conventionally not self-supporting but, rather, are positioned against an elevated surface, such as a wall or the edge of a roof, to support the ladder at a desired angle. A user then ascends the ladder to obtain access to an elevated area, such as access to an upper area of the wall or access to a ceiling or the roof. A pair of feet or pads, each being coupled to the bottom of an associated rail of the ladder, are conventionally used to engage the ground or some other supporting surface.

In certain industries, such as in the telecommunications industry, ladders are used to access overhead cables or utility lines (e.g., cables or wires used for telephones, cable television, etc). In such cases, the ladders are sometimes supported at their upper ends by a utility pole or other vertical structure. In some situations, the upper end of the ladder is actually supported by a utility line extending generally horizontally between adjacent utility poles or towers. In such cases, the ladders have conventionally been fitted with "cable hooks" or "strand hooks" which are attached to the top of the ladder and simply hook over the top of the utility cable. The top of the ladder, thus, rests against and is supported by the horizontally extending utility cable. However, while the cable hooks generally engage the utility cable to provide support to the ladder, if the ladder shifts or tilts relative to utility cable (e.g., because of unstable ground or because of the user of the ladder leaning out to far to the side and causing the loading on the ladder to be unbalanced), one or both of the cable hooks may disengage the utility cable such that the ladder loses support and stability. This obviously creates a dangerous situation for the user of the ladder.

Some efforts have been made to provide an engagement device that provides additional security over traditional cable hooks. For example, U.S. Pat. No. 7,219,766 issued to Deuer on May 22, 2007 (the disclosure of which is incorporated by reference herein in its entirety), describes a "mid-span fall protection system" for ladders. The Deuer patent describes cable hooks, with one of the cable hooks having a latch member pivotally coupled therewith. The latch functions in conjunction with the cable hook, similar to a gate of a carabineer. When a utility member pushes upward against the latch member, the latch member is displaced permitting the utility cable to pass by. The latch member then closes (being biased by a spring toward the closed position) to capture the utility cable in an area defined by the cable hook and the latch. When it is desired to release the utility cable, a user pulls on a line tethered to the latch member to keep the latch member open while lifting the ladder to displace the cable hooks away from the utility cable. In another example, U.S. Pat. No. 5,054,581 issued to Henson on Oct. 8, 1991 (the disclosure of which is incorporated by reference herein in its entirety) describes a device that attaches to two vertically adjacent rungs of a ladder and then provides a single point attachment to a utility cable.

Also, recognizing the potential for instability in ladders in various circumstances (such as the above mentioned "shifting" of the ladder), and in an effort to improve safety of ladders generally, some efforts have been made to provide a safety line for coupling with a user's harness to help secure a user to the ladder in case of an accidental slip or fall. For example, the Deuer patent discloses a rope that is coupled to a cross-member extending between the two side rails of the ladder. An "auto-latching/locking" mechanism is coupled with the rope which requires manual release for removal. Such an auto-latching mechanism is described in U.S. Pat. No. 5,855,251 issued to Deuer on Jan. 5, 1999 (the disclosure of which is incorporated by reference herein in its entirety).

However, such proposed solutions have not proved to be entirely workable and there is a continuing desire in the industry to provide improved functionality of ladders while also improving the safety and stability of such ladders.

Additionally, even when ladders are stabilized, there is the risk of a user falling from the ladder. As such it is desirable to provide fall arrest or fall protection systems and devices as a safety precaution.

Further, adjustment systems are required when working with various types of ladders, including extension ladders. Often, a rope with a single pulley is used to help adjust the height of a ladder. However, the rope may have a free end that may provide a hazard for a user or become caught in relatively moving components of the ladder.

It is a continual desire of the industry to provide ladders with an improved user experience. Such may include, for example, the ergonomics of the ladder, the ease of use of the ladder and enhanced safety features.

SUMMARY

The present invention relates to ladders and, more particularly, various configurations of ladders, as well as to methods relating to the use and manufacture of ladders.

In one embodiment, a ladder is provided comprising a base section, a fly section slidably coupled to the base section and a rope and pulley system. The rope and pulley system comprises a rope having a first end coupled to base section and a second end coupled to the fly section and a plurality of pulleys configured so that at a first section of rope extends along a side rail of the fly section and so that another section of the rope extends from a lower portion of the base section to an upper portion of the fly section while being positioned between a pair of rails of the fly section.

In one embodiment, the another section of rope is substantially centered along both the base section and the fly section.

In one embodiment, the plurality of pulleys includes at least one pulley coupled with the fly section and at least one pulley coupled with the base section. In one particular embodiment, the plurality of pulleys includes at least two pulleys coupled with the fly section and at least two pulleys coupled with the base section. In one other particular embodiment, the plurality of pulleys includes at least two pulleys coupled with the fly section and at least three pulleys coupled with the base section.

In one embodiment, the first end of the rope is coupled with a J-bracket fixed to the base section.

In one embodiment, the first section of the rope extends from the first end that is coupled with the base section through a first pulley of the plurality of pulleys, the first pulley being coupled with the fly section. Additionally, the rope may include a second section of rope that extends from the first pulley to a second pulley, the second pulley being coupled with the base section at a location adjacent the first end of the rope, a third section of rope extends from the second pulley to a third pulley, the third pulley being coupled to a lower portion of the base section adjacent one of a pair of rails of the base section, and a fourth section of rope extends from the third pulley to a fourth pulley, the fourth pulley being coupled to the base section at a location between the pair of rails of the base section. Further, the "another" section of rope is a fifth section extending from the fourth pulley upwards between the pair of rails of the base section.

In one embodiment, the fifth section of rope extends to a fifth pulley that is coupled with the fly section. Additionally, the rope may include a sixth section extending from the fifth pulley to the second end of the rope.

In one embodiment, the base section includes a plurality of rungs extending between the pair of rails of the base section and the fly section includes a pair of rails and a plurality of rungs extending between the rails of the fly section, wherein the fifth section of rope is positioned in front of the rungs of the base section and the rungs of the fly section when the ladder is in an orientation of intended use.

In one embodiment, the rope and plurality of pulleys are arranged such that a downward force applied to third section of rope urges the fly section upward relative to the base section.

In one embodiment, the ladder further comprises an ascender device coupled to the another section of rope, the ascender device configured to be coupled with a harness worn by a user of the ladder.

In one embodiment, the ascender device is configured to slide freely upwards along the rope without further manipulation by a user when the ladder is in an orientation of intended use. The ascender device may be further configured to inhibit downward movement along the rope until a user actuates a release mechanism.

In one embodiment, the ladder further comprises a pair of adjustable support members coupled with the base section, the pair of adjustable support members being configured to be adjusted relative to a pair of rails of the base section in at least one of height and width relative to the pair of rails.

In one embodiment, the fly section includes a pair of rails and the ladder further comprises a pair of hooks, each hook being positioned adjacent an upper end of an associated rail of the pair of rails.

In one embodiment, the ladder further comprises a securing apparatus coupled adjacent the upper end of the pair rails, the securing apparatus including a pair of spaced apart engaging members and a cross-member coupled therebetween, each engagement member being pivotally coupled with an associated rail of the pair of rails.

In accordance with one embodiment of the invention, another ladder is provided. The ladder comprises a base section comprising a first pair of spaced apart rails and a plurality of rungs extending between and coupled with the first pair of spaced apart rails, a fly section slidably coupled to the base section, the fly section including a second pair of spaced apart rails and a plurality of rungs extending between and coupled with the second pair of spaced apart rails, and a rope and pulley system. The rope and pulley system comprises: a rope having a first end coupled to a the base section, the rope extending sequentially from the first end through a first pulley coupled with the fly section, through a second pulley coupled with the base section, through a third pulley coupled with the base section, through a fourth pulley coupled with the base section, through a fifth pulley coupled with the fly section and to a second end, the second end of the rope being fixed to the fly section.

In one embodiment, the second pulley is positioned adjacent the first end of the rope.

In one embodiment, the third and fourth pulleys are positioned along a lower portion of the base section when the ladder is in an orientation of intended use.

In one embodiment, the fifth pulley is positioned along an upper portion of the fly section.

In one embodiment, the ladder further includes an ascender device coupled with the rope at a location between the fourth and fifth pulleys. In one particular embodiment, the ascender device is configured to slide freely upwards along the rope without further manipulation by a user when the ladder is in an orientation of intended use, while inhibiting downward movement along the rope until a user actuates a release mechanism.

In one embodiment, the ladder further comprises a pair of adjustable support members, the support member being coupled with an associated on of the first pair of spaced apart rails, the pair of adjustable support members being configured to be adjusted relative to the first pair of spaced apart rails of the base section in at least one of height and width.

In one embodiment, the ladder further comprises a pair of hooks, each hook being positioned adjacent an upper end of an associated rail of the second pair of spaced apart rails. The ladder may further include In one embodiment, a securing apparatus coupled adjacent the upper end of the second pair of spaced apart rails, the securing apparatus including a pair of spaced apart engaging members and a cross-member coupled therebetween, each engagement member being pivotally coupled with an associated rail of the pair of rails.

In accordance with another embodiment of the invention, a method of operating a ladder is provided. The method comprises: providing a ladder having a fly section slidable coupled to a base section, coupling a first end of the rope to the base section, passing the rope through a plurality of pulleys, and coupling a second of the rope to the fly section, and adjusting the fly section of the ladder relative to the base section by pulling on a section of the rope.

In one embodiment, the method further includes maintaining a substantially common level of tautness in the rope between the first end and the second end regardless of the position of the fly section relative to the base section.

In one embodiment, the method includes coupling a fall arrest mechanism to the rope and configuring the fall arrest mechanism to freely slide upwards along the rope while inhibiting movement of the fall arrest mechanism downwards along the rope unless a release mechanism is actuated by a user.

It is noted that the embodiments described herein are not to be considered mutually exclusive of one another and that any feature, aspect or component of one embodiment described herein may be combined with other features, aspects or components of other embodiments.

BRIEF DESCRIPTION OF THE DRAWINGS

The foregoing and other advantages of the invention will become apparent upon reading the following detailed description and upon reference to the drawings in which.

DETAILED DESCRIPTION

Various embodiments of ladders and ladder components are described herein. It is noted that the described embodiments are not to be considered mutually exclusive of one another and that any feature, aspect or component of one embodiment described herein may be combined with other features, aspects or components of other embodiments.

Figure 1:
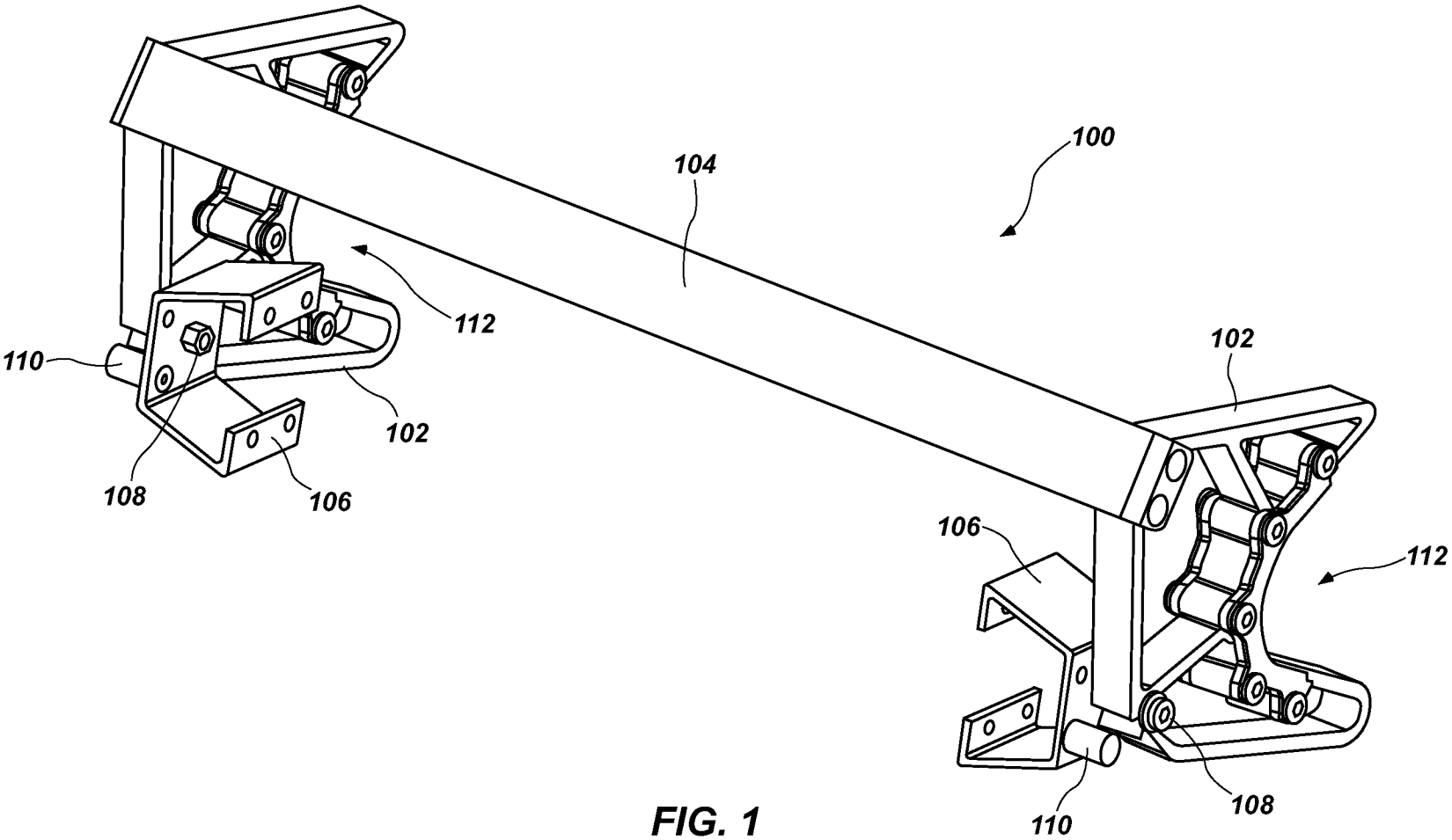
FIG. 1 is a front perspective view of an apparatus for use with a ladder according to an embodiment of the present invention.
Figure 2:
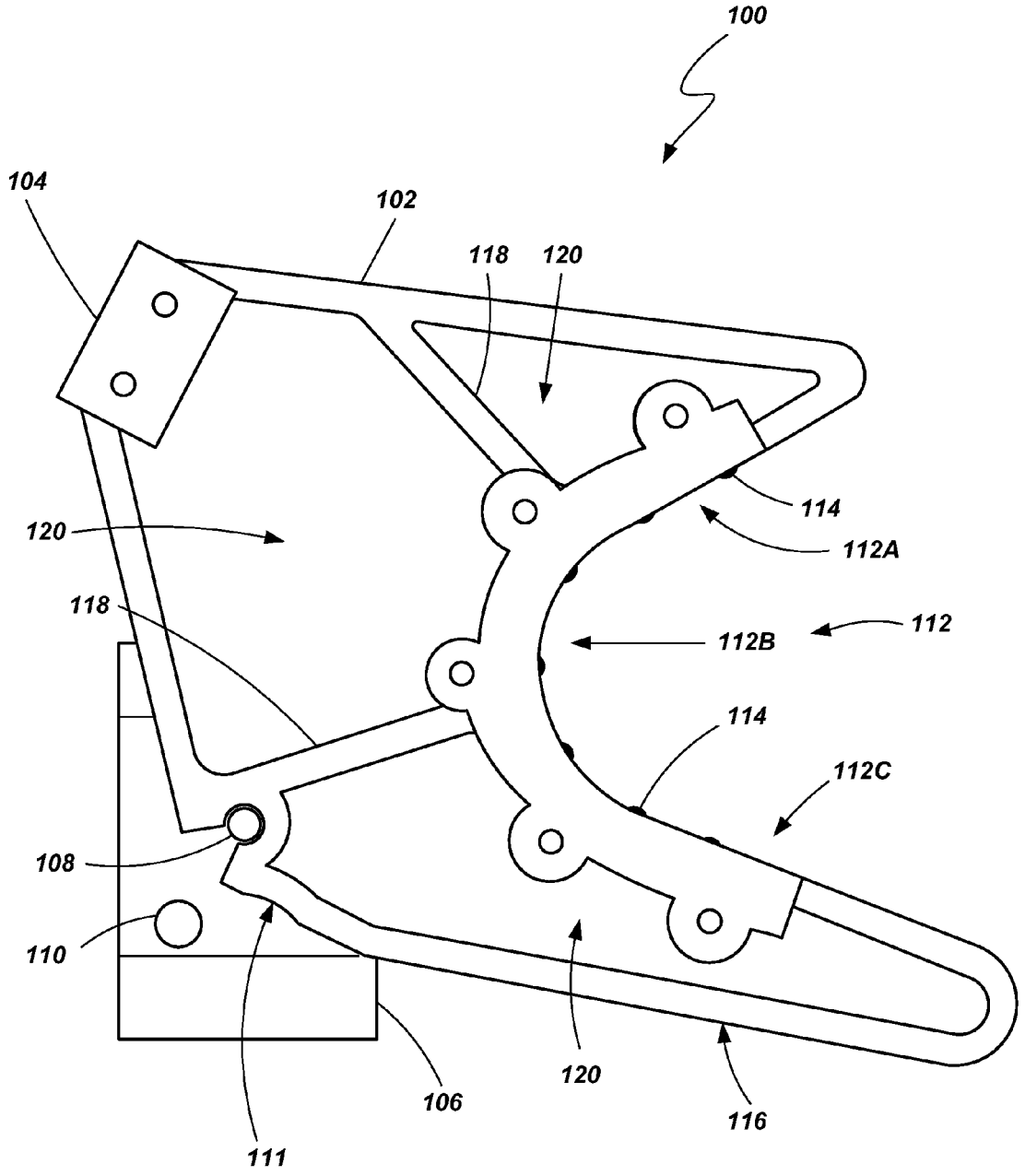
FIG. 2 is side view of the apparatus shown in FIG. 1.

Referring initially to FIGS. 1 and 2, a securing apparatus 100 is shown for use with a ladder when it is desired to support the ladder using a generally horizontally extending overhead line (e.g., a utility line such as used in the telecommunications industry). The apparatus 100 includes two spaced apart engagement members 102 that may be coupled together by a cross-member 104 which may include, for example, a bar or a plate member. While the distance that the engagement members are spaced from each other may be determined, at least in part, on the size of the ladder (e.g., the spacing of the rails from one another), in one example, the engagement members 102 may be spaced approximately 18 inches to 24 inches away from one another. Each of the engagement members 102 are pivotally coupled to an associated bracket 106 by way of a pin or shaft 108.

The brackets 106 are configured for attachment with associated rails of a ladder (e.g., an extension ladder) such as by way of a rivet, a screw, bolt or other appropriate means (including adhesives, welding or other joining methods depending on the materials being used). In other embodiments, the brackets 106 may be integrally formed in the rails of the ladder or the pin/shaft 108 may be coupled directly to the rails of the ladder. Additionally, while shown as a simple pin or shaft 108, the pivoting arrangement between the engagement member 102 and its associated bracket 106 (or ladder rail) may include any of a variety of known bearing mechanisms.

A stop member 110 may be provided in association with either or both brackets 108 to prevent the engagement members 102 from rotating beyond a desired point. For example, referring specifically to FIG. 2, if the apparatus were coupled with a ladder (as will be discussed in further detail below), absent other forces being applied to the engagement members 102, gravity would cause the engagement members 102 to rotate clockwise about the pin or shaft 108 (based on the orientation shown in FIG. 2) until a portion of the engagement member 102 (e.g., an abutment surface 111) abuts the stop member 110. The stop member 110, in conjunction with gravity, thus, holds engagement member 102 in a desired position relative to the side rails of a ladder by preventing it from rotating further. Other stop members may additionally, or alternatively, be employed if desired. For example, in another embodiment, the cross member 104 may be configured to abut a top portion of the rails of a ladder to impede further rotation and to place the mechanism in a desired position for engagement with a utility line or other support member.

The engagement members 102 include a cup portion 112 having an upper portion 112A, a central portion 112B and a lower portion 112B. In the embodiment shown, the central portion 112B includes an arcuate section that extends through an arc angle of greater than 90°. In other embodiments, the arcuate section may be replaced by an angle (or a series of angles) such that the upper portion 112A lies at an acute angle relative to the lower portion 112C. In another embodiment, the upper portion 112A and the lower portion 112C may be configured to extend substantially parallel to each other. The cup portion 112 is configured to receive a portion of an overhead line therein (as will be further discussed below). The surface of the cup portion 112 may be textured and may be formed of, or coated with, a material to provide frictional resistance when it engages an overhead line. For example, the cup portion 112 may be covered with a rubber material having a plurality of ridges, raised sections or other surface features 114 that are configured to help frictionally engage or grip a portion of a utility cable or overhead line. Additionally, the material covering of the cup portion 112 may assist in protecting the overhead line from damage when being engaged by the apparatus 100.

The apparatus 100 may be formed from a variety of materials using various methods of manufacturing as will be appreciated by those of ordinary skill in the art. For example, the engagement members 102, the cross-member 104 and the brackets 106 may be formed of metal, metal alloys, plastic materials, composite materials or various combinations of such materials. Such components may be formed by various techniques including machining, molding, stamping, forging, extruding and so forth. In one particular embodiment, the engagement members 102 are formed of an aluminum material with the cross-member 104 with the brackets being formed of a metal or metal alloy. In another embodiment, the engagement members 102 may be formed of a plastic material. As seen in FIGS. 1 and 2, the engagement members 102 may be formed to include a peripheral wall member 116 and one or more inner structurally reinforcing members 118 defining various openings or cells 120. Such a configuration provides appropriate strength for the apparatus while reducing the weight of the apparatus significantly. Of course, other structural configurations may be used in forming the engagement members 102 as will be appreciated by those of ordinary skill in the art.

It is noted that the apparatus 100, according to the embodiment shown in FIGS. 1 and 2, does not include any springs, biasing members, actuators or locking mechanisms. Rather, the apparatus 100 utilizes gravity in conjunction with the positioning of the ladder by a user thereof to engage, and maintain such engagement with, an overhead line. Additionally, as will be seen with further discussion below, no locks or actuators are required to be activated by a user either while on the ladder, or while standing at the base of the ladder, to release the apparatus from an overhead line. Rather, all that a user has to do to disengage the overhead line is to lift the ladder as one would normally do with conventional cable hooks.

Figure 3:
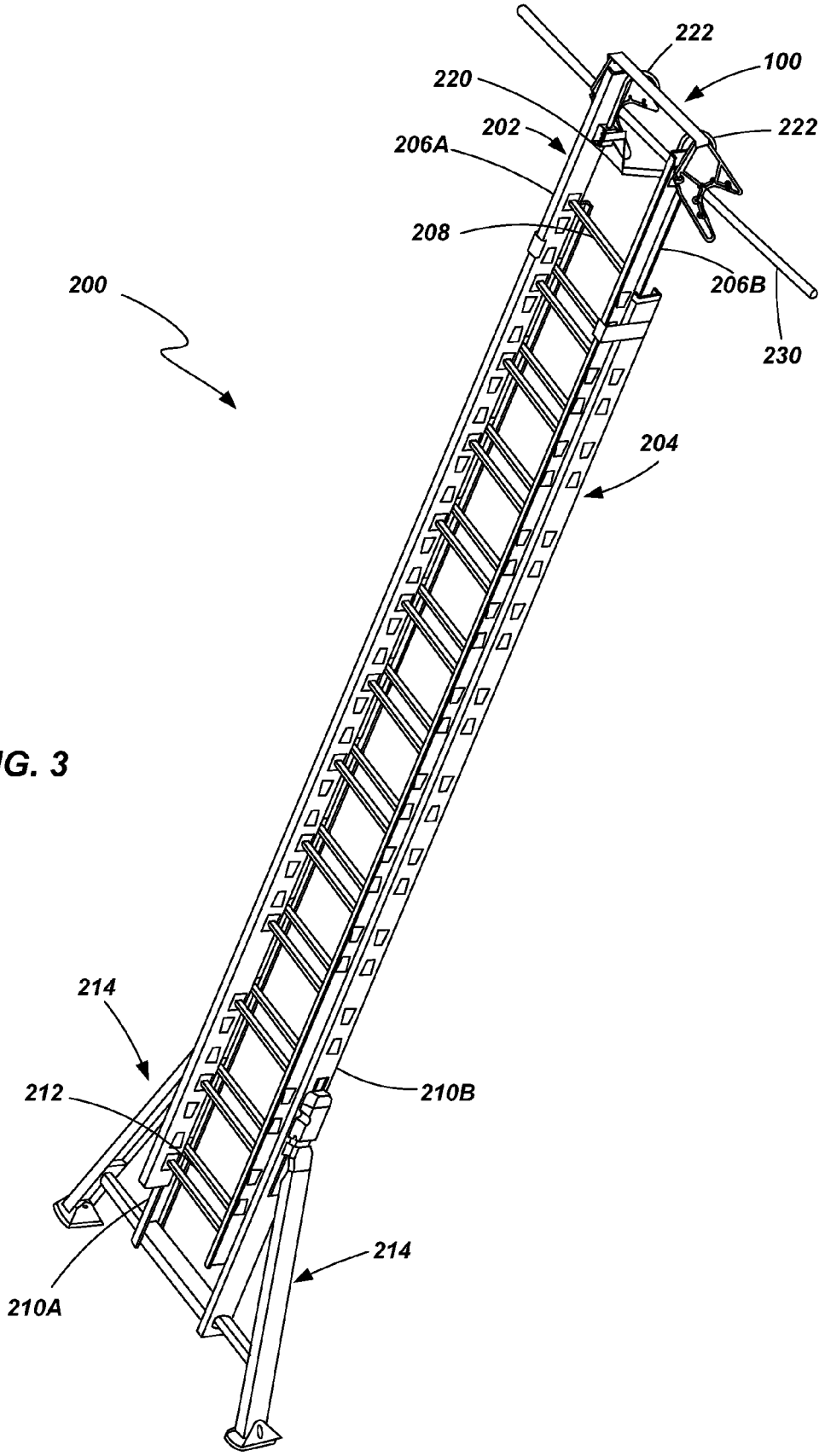
FIG. 3 is a perspective view of a ladder having the apparatus of FIG. 1 placed in a first position in accordance with an embodiment of the present invention.
Figure 4:
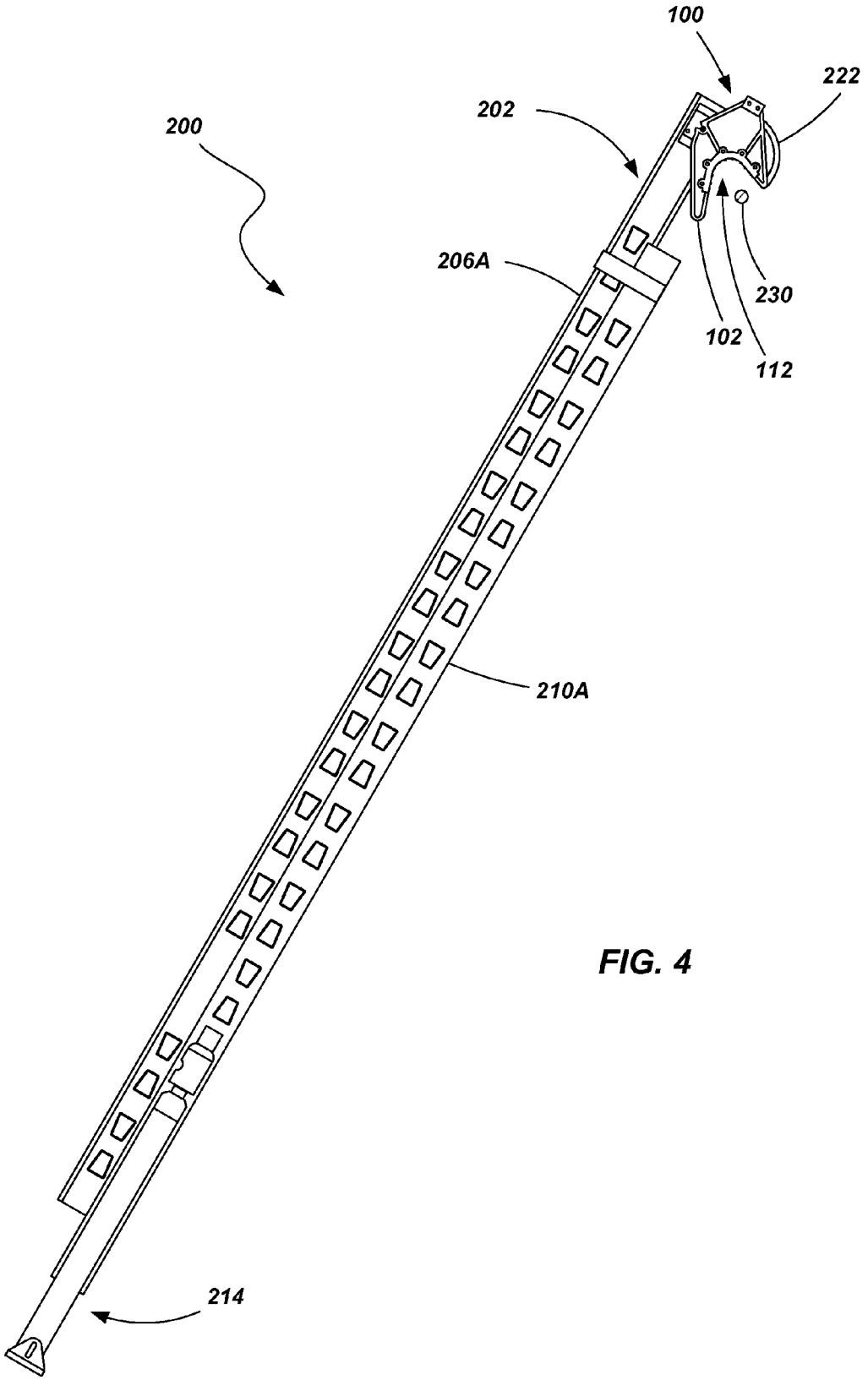
FIG. 4 is a side view of the ladder shown in FIG. 3.

Referring now to FIGS. 3 and 4, a ladder 200 is shown that includes a securing apparatus 100 such as described above. The ladder 200 is configured as an extension ladder and includes a first assembly 202 and a second assembly 204 slidably coupled with the first assembly. The first assembly 202 includes a pair of spaced apart rails 206A and 206B with a plurality of rungs 208 extending between, and coupled to, the rails 206A and 206B. Similarly, the second assembly 204 includes a pair of spaced apart rails 210A and 210B with a plurality of rungs 212 extending between, and coupled to, the rails 210A and 210B. While not specifically shown in the drawings, one or more mechanisms are associated with the first and second assemblies 202 and 204 to enable selective positioning of the first assembly 202 relative to the second assembly 204. This enables the ladder 200 to assume a variety of lengths (or, more specifically, heights when in an intended operating orientation) by sliding the first assembly 202 relative to the second assembly 204 and locking the two assemblies in a desired position relative to one another. By selectively adjusting the two rail assemblies 202 and 204 relative to each other, a ladder can be extended in length to nearly double its collapsed or shortest state, as will be appreciated by those of ordinary skill in the art. By way of example, a rung lock apparatus is described in U.S. Pat. No. 5,429,207 to Frank et al., issued Jul. 4, 1995, the disclosure of which is incorporated by reference herein in its entirety.

In many conventional extension ladders, feet members may be coupled to the lower ends of the rails 210A and 210B to support the ladder on the ground or other surface. Such a configuration is contemplated as being used in other embodiments of the present invention. In the specific embodiment shown, adjustable support members 214 are coupled with the second assembly 204 to provide increased lateral stability as well as the ability to adjust the ladder for support on uneven surfaces. An example of such adjusting members is described in U.S. Patent Application Publication No. US 20100300805 (application Ser. No. 12/714,313) published on Dec. 2, 2010, the disclosure of which is incorporated by reference herein in its entirety. Again, as noted above, the present invention is not limited to particular types of ladders and may be implemented in conjunction with conventional extension ladders, straight ladders or even combination ladders if desired.

The ladder 200 further includes a brace member, referred to as a V-bar 220, located at the upper end of the first assembly 202 which extends between and is coupled to the rails 206A and 206B of the first assembly 202. The V-bar 220 is shaped to engage a vertical structure, such as a utility pole, and be supported thereby. While not specifically shown, the inner surface of the V-bar 220 (the surface that will engage a support structure) may be textured, coated, include protruding members (e.g., barbs or prongs), include an undulating surface, or otherwise configured to provide slip resistance when positioned against a vertical supporting structure such as a utility pole.

Additionally, the ladder 200 includes a pair of hooks 222 (e.g., cable hooks), one associated with each rail 206A and 206B of the first assembly 202. The hooks 222 are configured to be positioned over and rest down upon an overhead line. As will be appreciated by those of ordinary skill in the art, the hooks 222 may be configured to be rotated from the position shown to a "stored" position so that they are largely placed within the envelope or volume defined by the rails 206A and 206B of the first assembly. Thus, for example, the hooks 222 may be selectively positioned in a first position with the hook ends extending to the backside of the ladder (as shown in the drawings) or in a second position where the hook ends are positioned between the two rails 206A and 206B, a rotation of approximately 90°. In the embodiment shown, the cable hooks 222 are installed along the inner surface of their associated rails 206A and 206B. However, in other embodiments, the cable hooks 222 may be positioned along some other surface, including a laterally outer surface of the associated rails 206A and 206B (e.g., opposite of that shown).

Figure 5A:
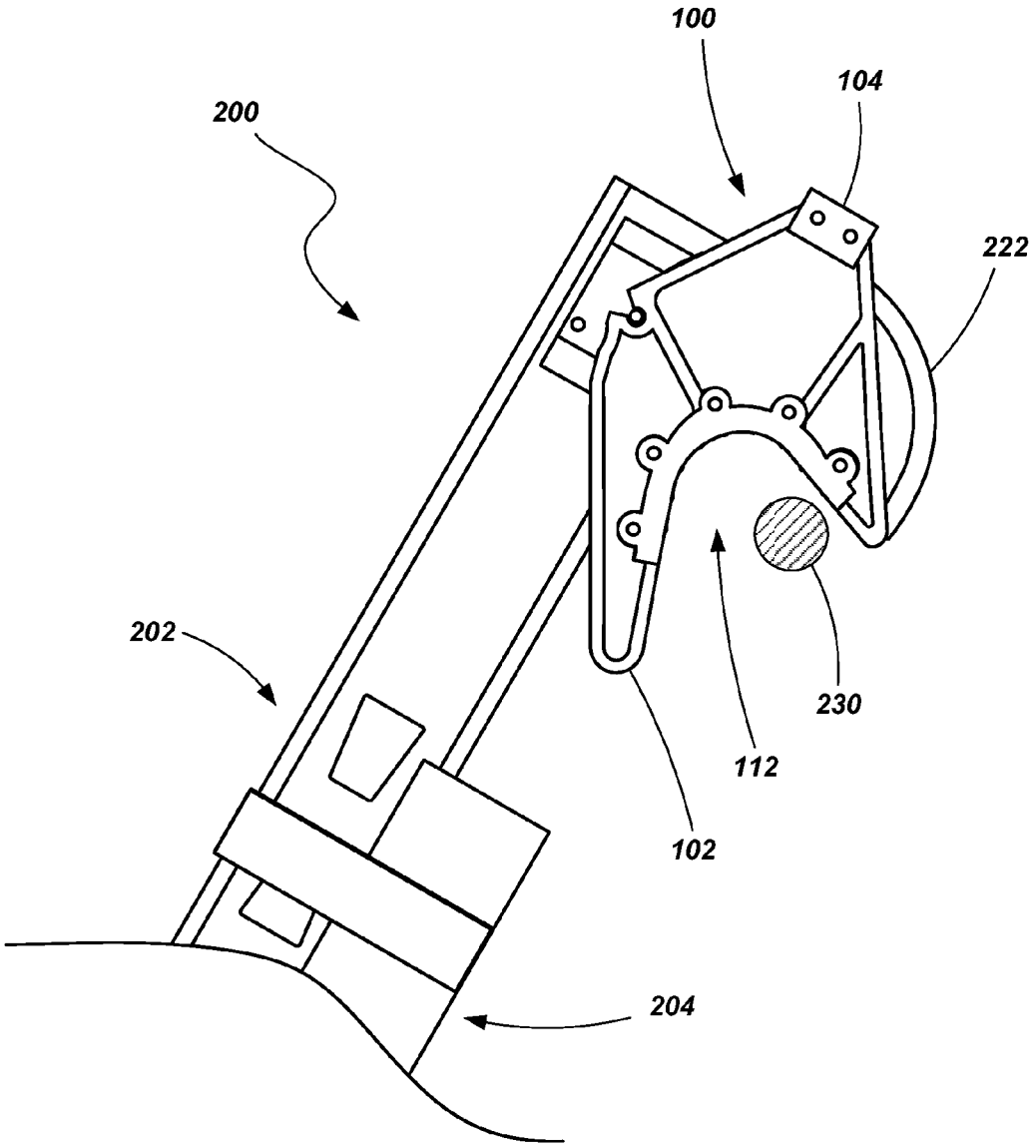
FIGS. 5A-5C are side views of a portion of the ladder shown in FIG. 3 with a component in various positions or stages or use.
Figure 5B:
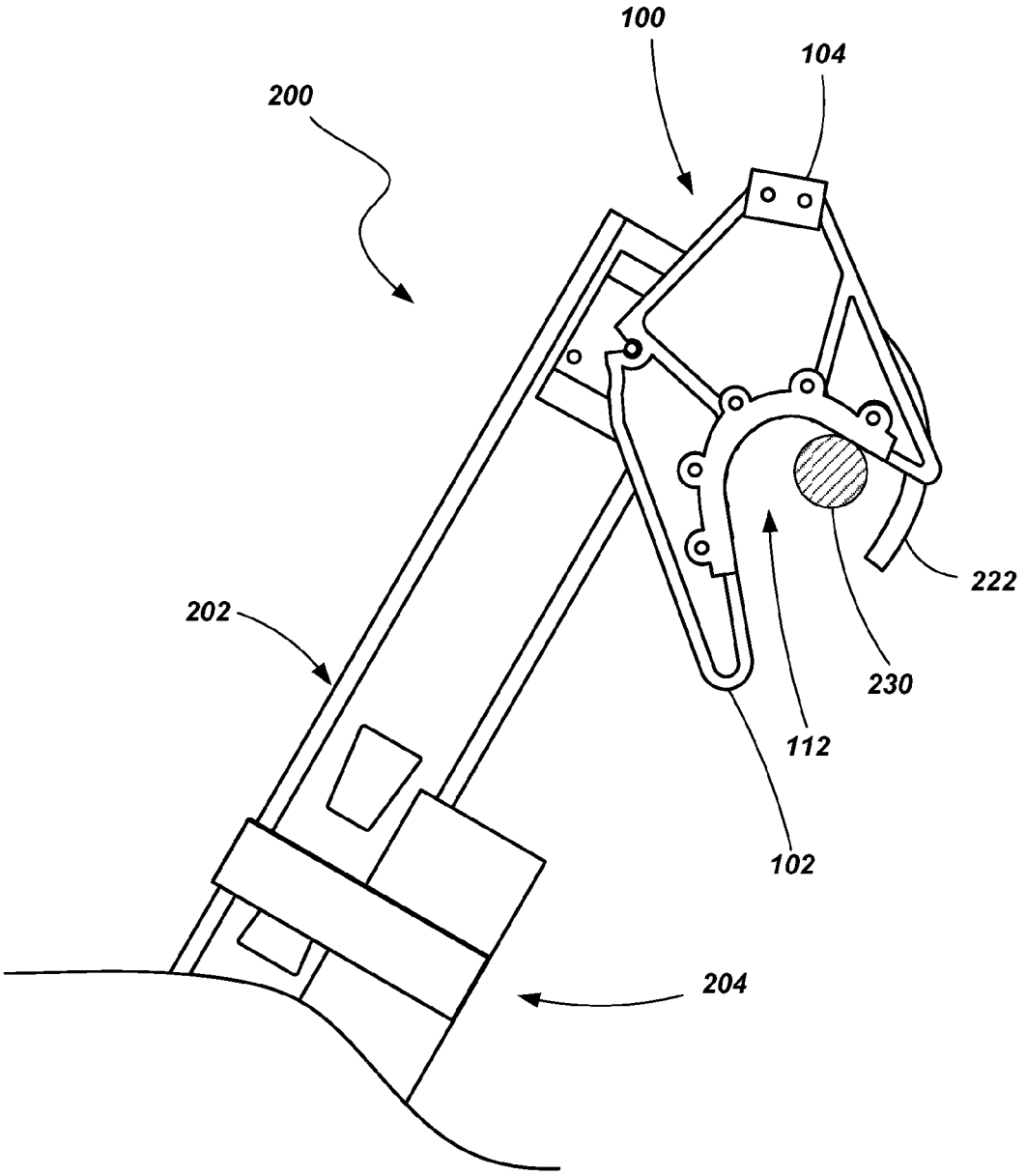
Figure 5C:
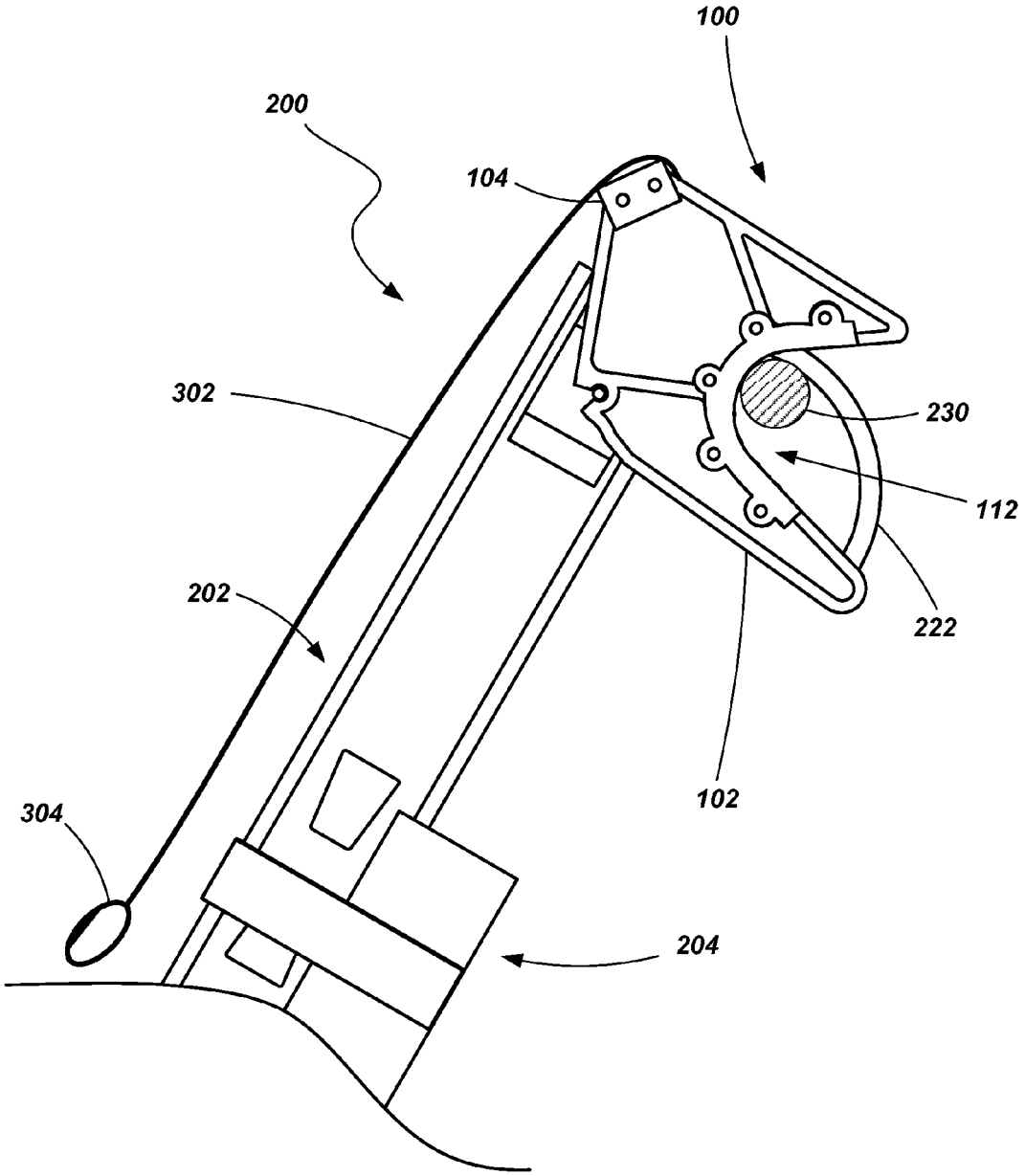

As shown in FIGS. 3 and 4, the securing apparatus 100 is coupled to first assembly 202 and is in a first position prior to engagement of an overhead line 230. When in this position, the cup portion 112 of the apparatus 100 and the open ends of the hooks 222 are positioned above the overhead line 230, ready for engagement therewith. This is also shown, in larger side view, in FIG. 5A. As shown in FIG. 5B, by lowering the upper portion of the ladder 200, the engagement members 102 are positioned to contact the overhead line 230, or, more specifically, the cup portions 112 of the engagement members 102 contact the overhead line 230. This results in the engagement members 102 (and associated cross member 104) rotating about the shaft/pin 108 as the hooks 222 begin to descend over the overhead line 230. As shown in FIG. 5C, the upper portion of the ladder 200 is lowered to point where the overhead line 230 is captured within the hooks 222. At the same time, the engagement members 102 continue to rotate, by virtue of the overhead line "pushing up" against the upper portion 112A (or even the middle portion 112B) of the engagement member's cup portion 112. When the hook 222 is engaging the overhead line—supporting the upper end of the ladder 200 in this position—the engagement member 102 is positioned such that the overhead line is encircled by the combination of the hook 222 and the cup portion 112 of the engagement member 102. It is noted that the lower portion 112C of the engagement member's cup portion 112 extends towards the outer end of the hook 222, across the otherwise open area of the hook 222, to help form this encircling structure.

Figure 6:
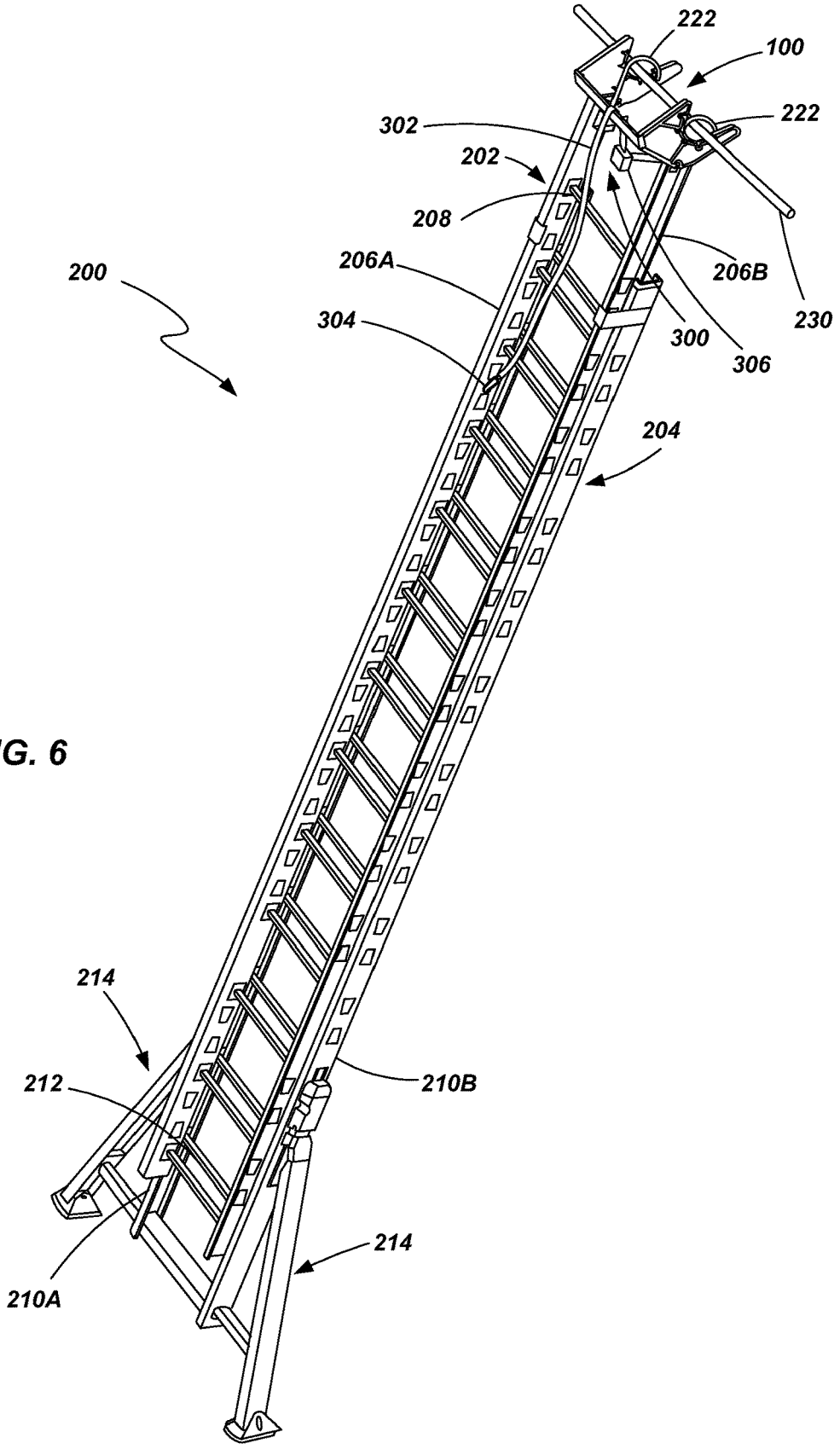
FIG. 6 is a perspective view of the ladder shown in FIG. 3 with the apparatus having been displaced to a second position.
Figure 7:
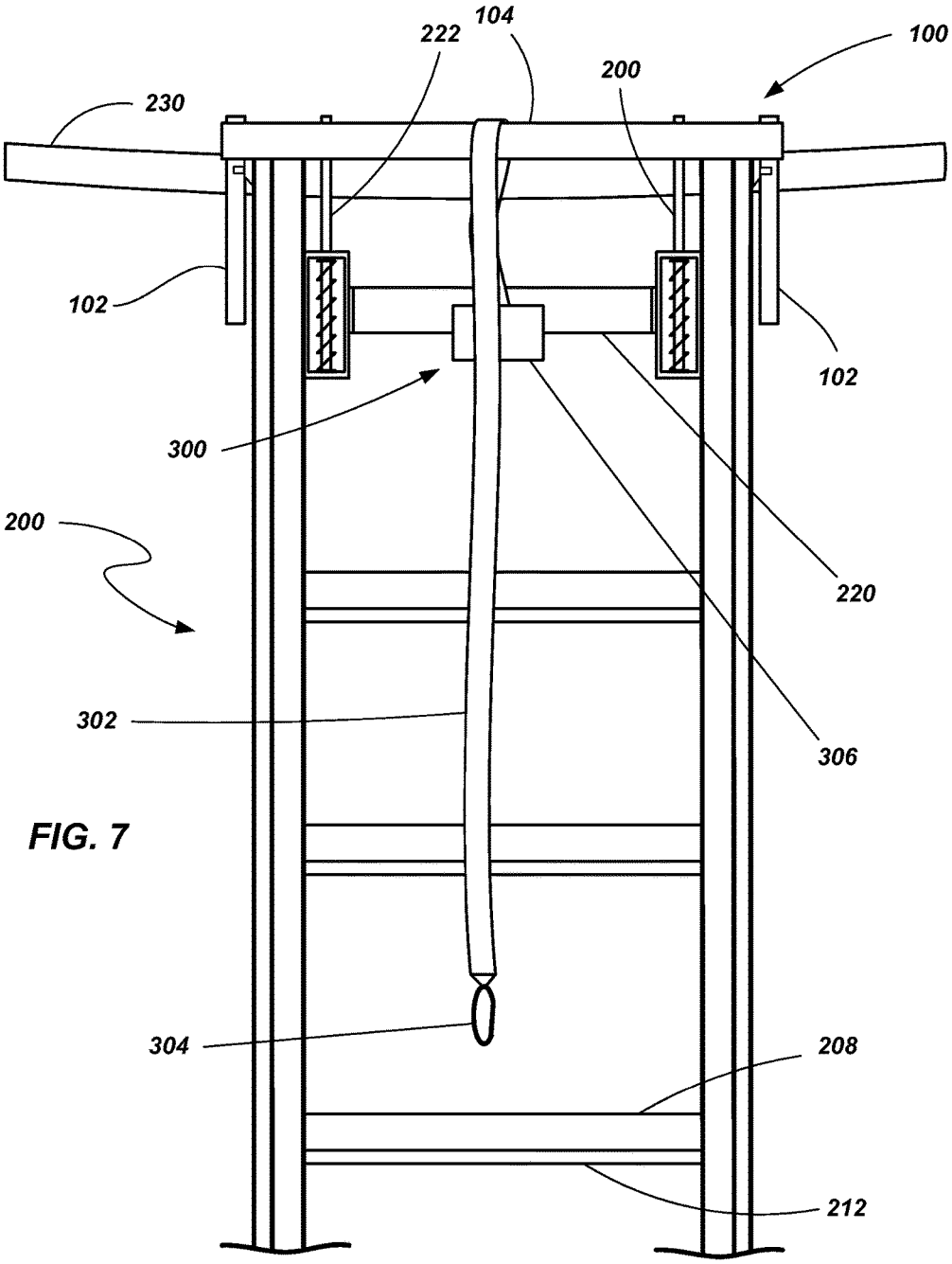
FIG. 7 is a front view of a portion of the ladder shown in FIG. 3.
Figure 8:
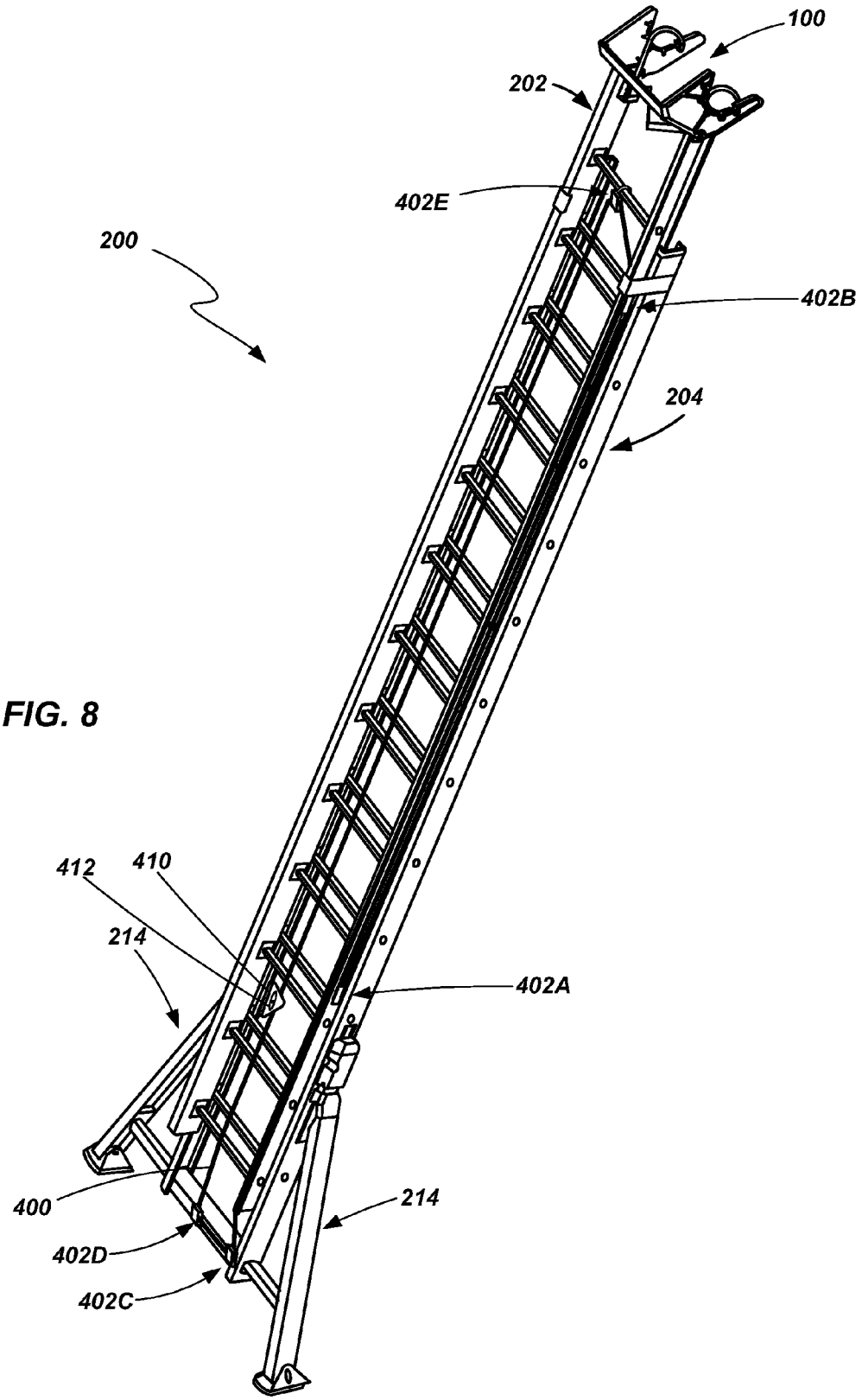
FIG. 8 is a perspective view of ladder including a positioning system and a fall arrest or prevention system.
Figure 9:
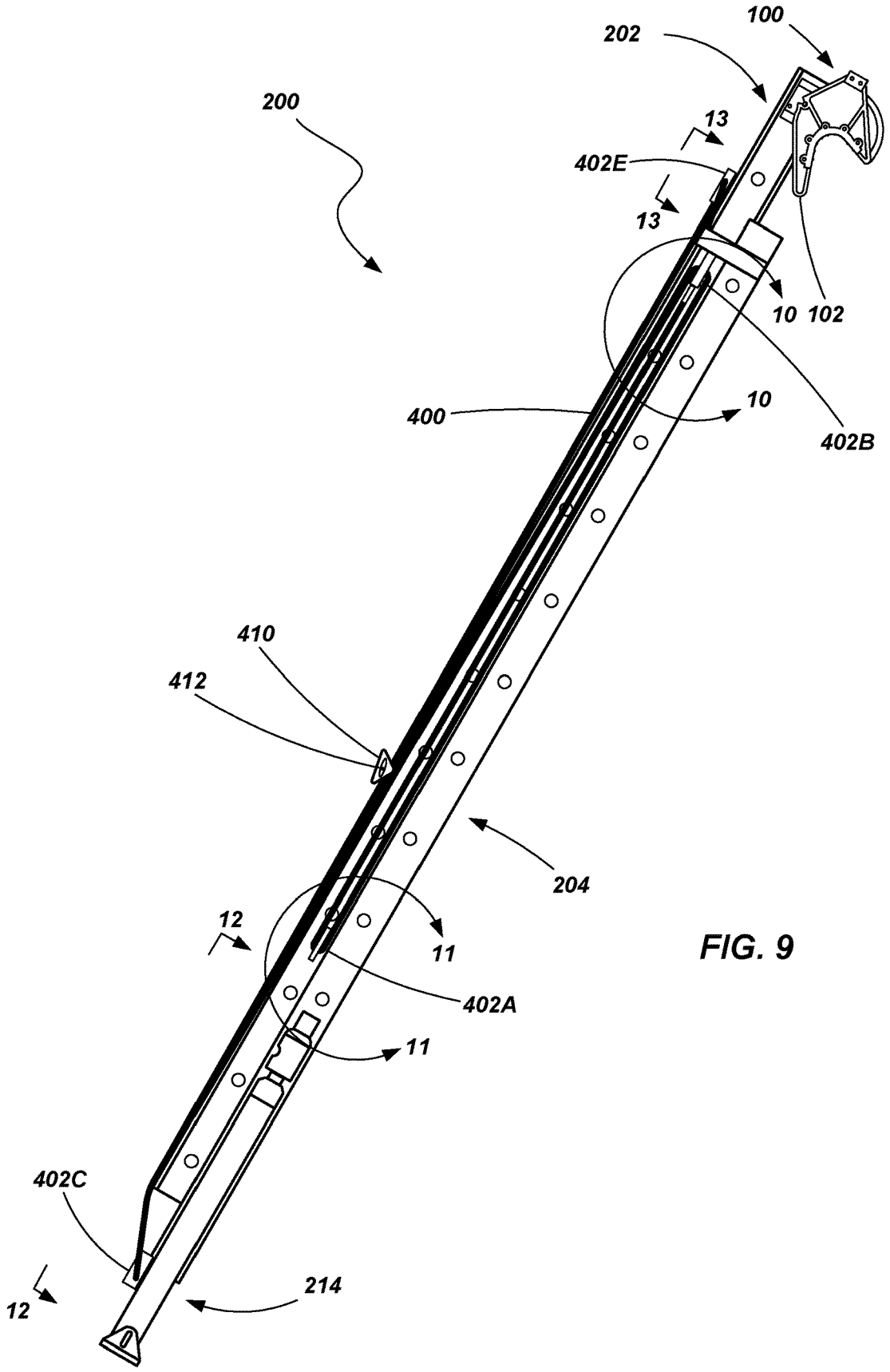
FIG. 9 is a side view of the ladder shown in FIG. 8.
Figure 10:
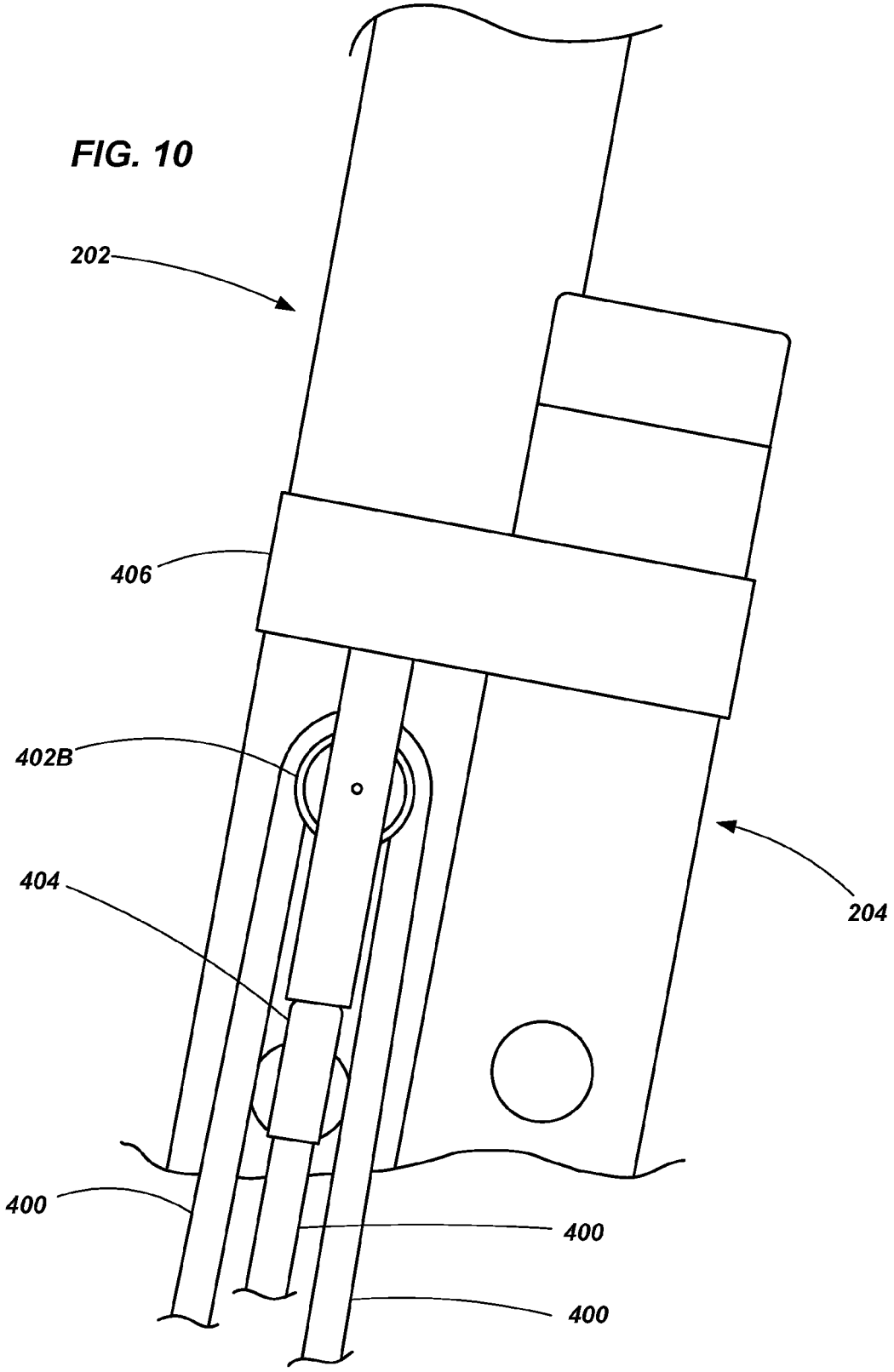
FIG. 10 is an enlarged side view of a portion of the ladder shown in FIGS. 8 and 9.
Figure 11:
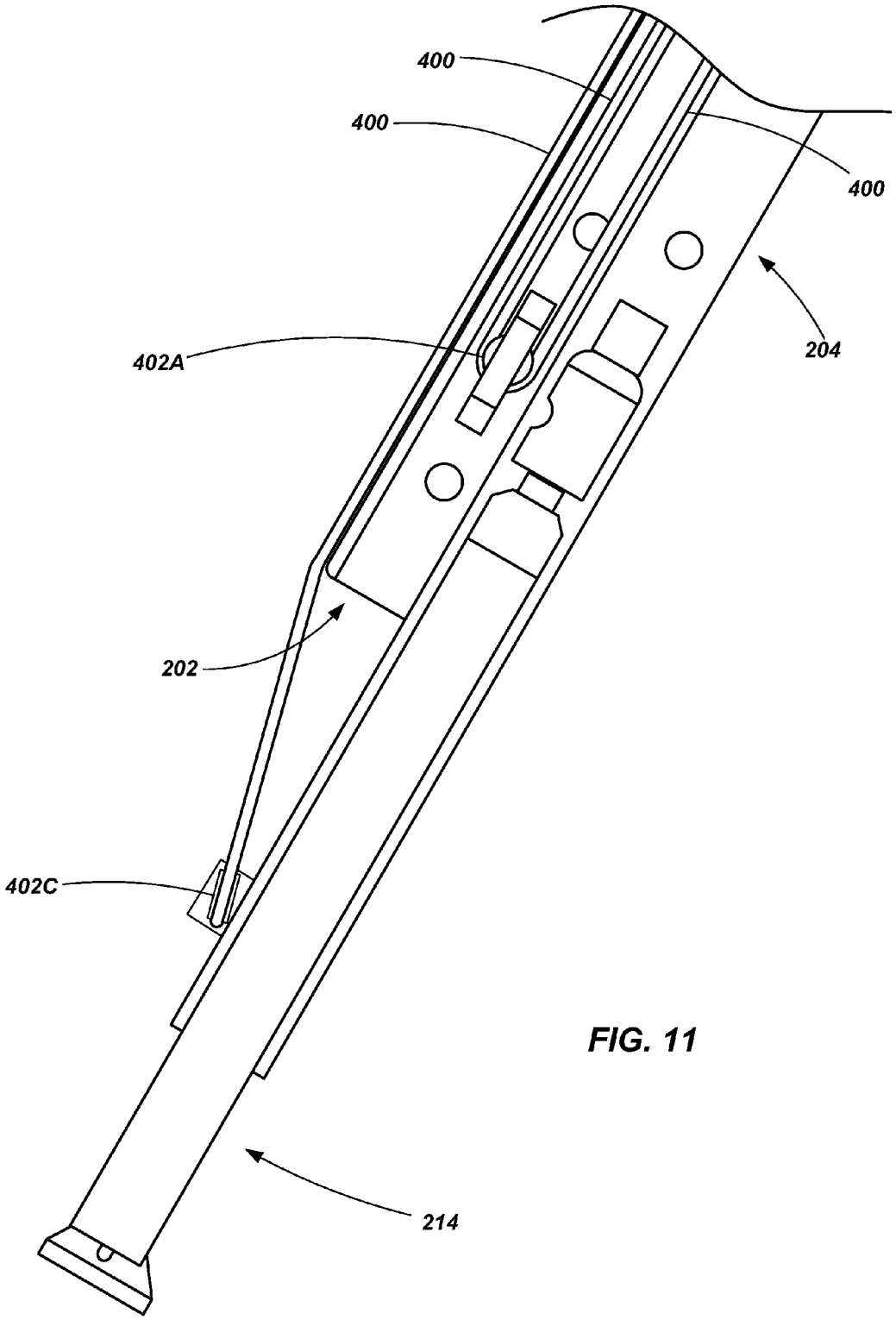
FIG. 11 is an enlarged side view of a portion of the ladder shown in FIGS. 8 and 9.
Figure 12:
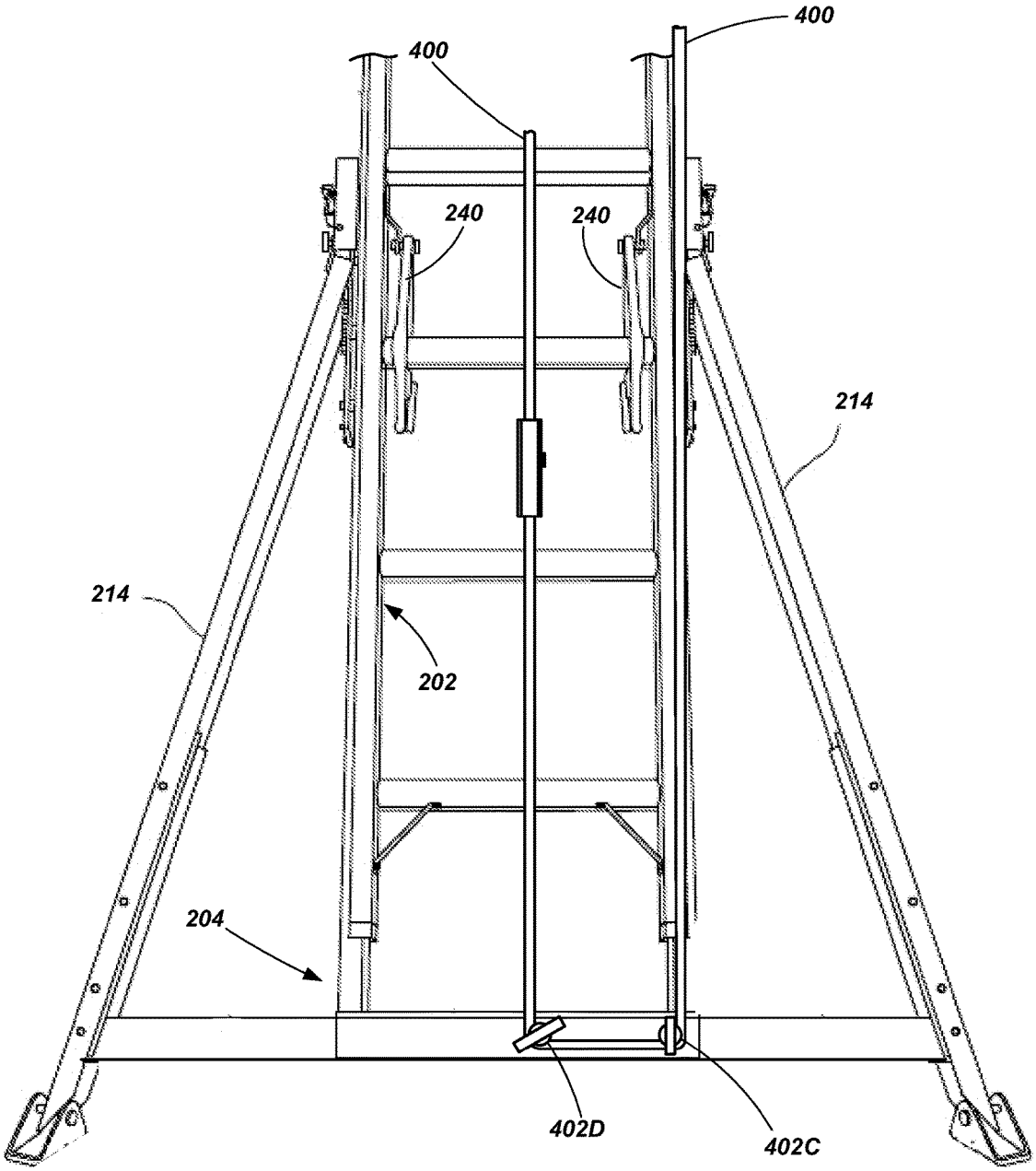
FIG. 12 is an enlarged front view of a portion of the ladder shown in FIGS. 8 and 9.
Figure 13:
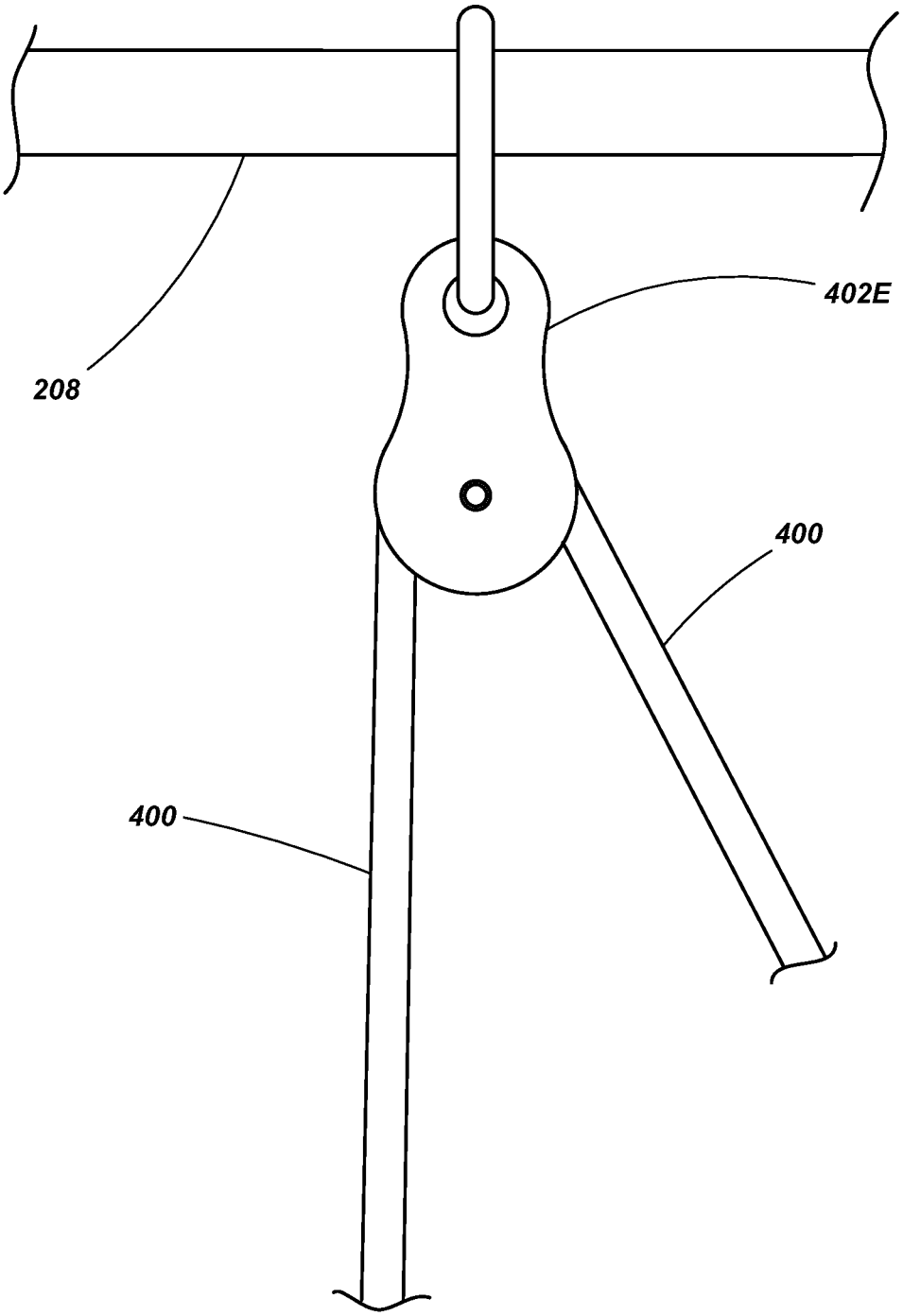
FIG. 13 is an enlarged front view of a portion of the ladder shown in FIGS. 8 and 9.

Thus, as shown in FIGS. 5C, 6 and 7, the overhead line 230 is encircled at two, spaced apart locations by structures defined in part by the hooks 222 and in part by the engagement members 102. The securement of the ladder 200 to the overhead line 230 remains in place by reason of gravity and the cooperative positioning of the hooks 222 with the engagement members 102. As long as a user is on the ladder 200, the additional weight of the user, combined with the weight of the ladder, continues to keep the ladder secured with the combined weight pulling down on the overhead line 230 through the hooks 222, the overhead line 230 in turn pushing up against the upper and/or middle portion 112A and 112B of the engagement member's cup portion 112 to keep the engagement members 102 rotated in the position shown in FIGS. 5C, 6 and 7 and keeping the overhead line encircled. Even if the ladder 200 were to somehow shift laterally (e.g., because the user is leaning over to one side of the other), because the two engagement members 102 are coupled together by the cross-member, both engagement members 102 will remain in position encircling the overhead line 230. In prior art ladders which, for example, only used hooks in an effort to secure the ladder, shifting of the ladder would potentially enable one of the hooks to disengage the overhead line such that the ladder was only supported by a single hook, permitting the ladder to spin or twist in a dangerous manner.

It is noted, however, that the cross-member need not be used in every embodiment. Indeed, the cross-member may be eliminated and the engagement members 102 may operate independent of one another (although each would continue to operate cooperatively with its associated hook 222). It is additionally noted that, while function of the engagement members 102 and hooks 222 is discussed in regard to the example of a "cable" or utility line, that the securing apparatus 100 may be utilized with other horizontal support members, including, for example, rigid bars or poles, such as may be coupled to a wall, roof line or other structure.

To remove the ladder from the supporting overhead line 230, a user merely needs to lift the ladder 200, or more correctly, displace the upper portion of the ladder 200 upwards until the hooks 222 are above the overhead line 230, and then remove the ladder 200. As the upper portion of the ladder 200 is displaced upwards, gravity causes the engagement members 102 to rotate enabling the overhead line 230 to escape from the cup portion 112. In other words, starting from the position shown in FIG. 5C, as the upper portion of the ladder 200 is displaced upwards, the engagement member 102 would rotate clockwise (based on the orientation shown in FIG. 5C), due to gravity, to the positions shown first in FIG. 5B and then in FIG. 5A, releasing the overhead line 230.

Thus, the present securing apparatus does not require that any locks or actuating mechanisms be attended to prior to setting the ladder up against the overhead line or when the ladder is to be removed from the site. Similarly, there are no locks that need to be attended to after ascension of the ladder or that need to be unlocked prior to descending the ladder—such configurations presenting an operational safety hazard since the ladder is "unlocked" or unsecured for a brief moment while the user ascends or descends the ladder.

It is noted that the embodiments discussed above depict the engagement members 102 being positioned outside the rails 206A and 206B of the ladder 200. In other embodiments, the engagement members could be positioned inwardly of the rails 206A and 206B and, even, inwardly of the hooks 222 if desired.

With continued reference to FIGS. 5C, 6 and 7, a safety apparatus 300 is shown in accordance with another embodiment of the present invention. The safety apparatus 300 includes a cable, rope, chain, strap or other elongated, flexible member (referred to generally as a line 302) coupled to the first assembly 202 of the ladder. An attachment mechanism 304 such as a hook or carabineer is attached to one end of the line 302 for coupling to, for example, a harness or safety belt of a user. The other end of the line 302 may be coupled to a retraction and locking mechanism 306 which is coupled to, for example, the first assembly 202 (although in other embodiments, it may be attached to other components of the ladder 200 including direct attachment to the apparatus 100 if desired). In one example, the retraction and locking mechanism 306 may include a mechanism such as described in U.S. Pat. No. 3,917,189 to Bryll, the disclosure of which is incorporated by reference herein in its entirety. Another example of a retraction/locking mechanism includes the self-retracting line known as RL20G/2FT MightyLite available from Miller®, a Honeywell company.

Thus, a user may couple the line 302 to their harness or safety belt and, as they ascend the ladder 200, the line will automatically retract within the mechanism 306. Similarly, as the user descends the ladder 200 at a controlled pace, the mechanism will allow the line to pay out so that the user may reach the bottom of the ladder 200 without the line 302 "catching" or stopping the user's descent. However, if a user happens to slip or fall while coupled to the line 302, the mechanism will, by virtue of the quick acceleration of the line, lock the line and prevent it from paying out any further, keeping the user from falling a substantial distance.

It is noted that, in one embodiment (as shown in FIGS. 5C, 6 and 7), the line 302 may be coupled with the first assembly 202 such that it extends up and over the cross-member 104 of the securing apparatus 100. In such a configuration, if a user were to fall, the weight of the user would be applied to the cross-member 104 ensuring that the engagement members did not release an overhead line 230. In fact, the rotation of the engagement members 102 due to the application of such force would actually cause the engagement members 102 to more strongly grip the overhead line 230, ensuring that the ladder 200 did not disengage the overhead line while a user was regaining a stable position on the ladder 200. In other embodiments, the retraction mechanism 306 may be coupled directly to the securing apparatus 100 (e.g., to the cross-member 104), or various other arrangements may be used in coupling one or more of the various components of the safety apparatus 300 to the ladder 200, the securing apparatus 100, or to both. Of course, other safety lines may be used in a similar manner without a retraction mechanism.

Other embodiments of fall arrest systems may also be utilized in conjunction with the ladders and assemblies described herein. For example, a fall arrest system such as described in U.S. Provisional Patent Application No. 61/879,506, filed on Sep. 18, 2013, the disclosure of which is incorporated by reference herein in its entirety.

Referring to FIGS. 8-13, a ladder 200 is shown with a positioning system for adjusting the height of the ladder and for assisting in fall prevention or restraint. The ladder 200 is configured as an extension ladder such as generally described above, with a first assembly 202 (also known as a fly section) having rails and rungs as described above, and a second assembly 204 (also known as a base section) having rails and rungs as described above. As noted above, a mechanism 240 (see FIG. 12) often referred to as a rung lock device may be included to enable adjustment of the fly section 202 relative to the base section 204 and to selectively maintain the fly section 202 at a desired position relative to the base section 204. A variety of such rung lock devices and mechanisms are known to those of ordinary skill in the art.

One non-limiting example of a rung lock is described in U.S. Pat. No. 3,565,211 to LeBlanc (issued Feb. 23, 1971) the disclosure of which is incorporated be reference herein in its entirety. The ladder may additionally include a variety of other components and features. For example, the ladder may include, without limitations, adjustable support members 214 and a securing apparatus 100 such as shown, or it may be devoid of such features.

A positioning system includes a single rope 400, cable or strap (which may also be generally referred to as a line) that passes through a series of pulleys (402A-402E). In the embodiment shown, a first end of the rope is fixed to a bracket 404 associated with what will be referred to as the second pulley 402B. The second pulley 402B is fixed to the base section 204 (see enlarged view in FIG. 10), either directly or by way of an intervening component such as a j-bracket 406 (that is fastened to rail of the base section 204 and wraps around a rail of the fly section 202 to assist in maintaining a slidable coupling between the fly section 202 and the base section 204). The rope 400 extends from this fixed position (adjacent the first pulley 402B) and passes through the first pulley 302A which is fixed to the fly section 202 (e.g., to a rail of the fly section 202—see enlarged view in FIG. 11) back up to, and through, the second pulley 402B (which, again, is fixed to the base section 204). The rope 400 then extends to, and through, a third pulley 402C which is fixed to a rail of the base section 204 (see enlarged views in FIGS. 11 and 12) such that it changes direction to extend laterally across the face of the ladder (i.e., from the rail toward a mid section of an associated rung). The rope 400 continues through a fourth pulley 402D, which is coupled with the base section 204 (e.g., by way of a rung or a brace member extending between the two rails, see enlarged view in FIG. 12) and then upwards, being positioned between the rails of the base section 204 (and eventually the fly section 202, depending on the relative positions of the base and fly sections) and in front of the associated rungs, up through a fifth pulley 402E that is coupled to an upper portion of the fly section 202 (e.g., to an uppermost rung 208, a v-bar, or other component associated with the fly section—see enlarged view in FIG. 13). Finally, the rope 400 extends from the fifth pulley 402E and is fixed to the fly section 202, such as to a rung or other component position below the fifth pulley 402. In some embodiments, the fifth pulley 402E may be eliminated and the end of the rope 400 may be fixed directly to an upper portion of the fly section 202 of the ladder (e.g., a rung, v-bar, or other component).

Figure 14:
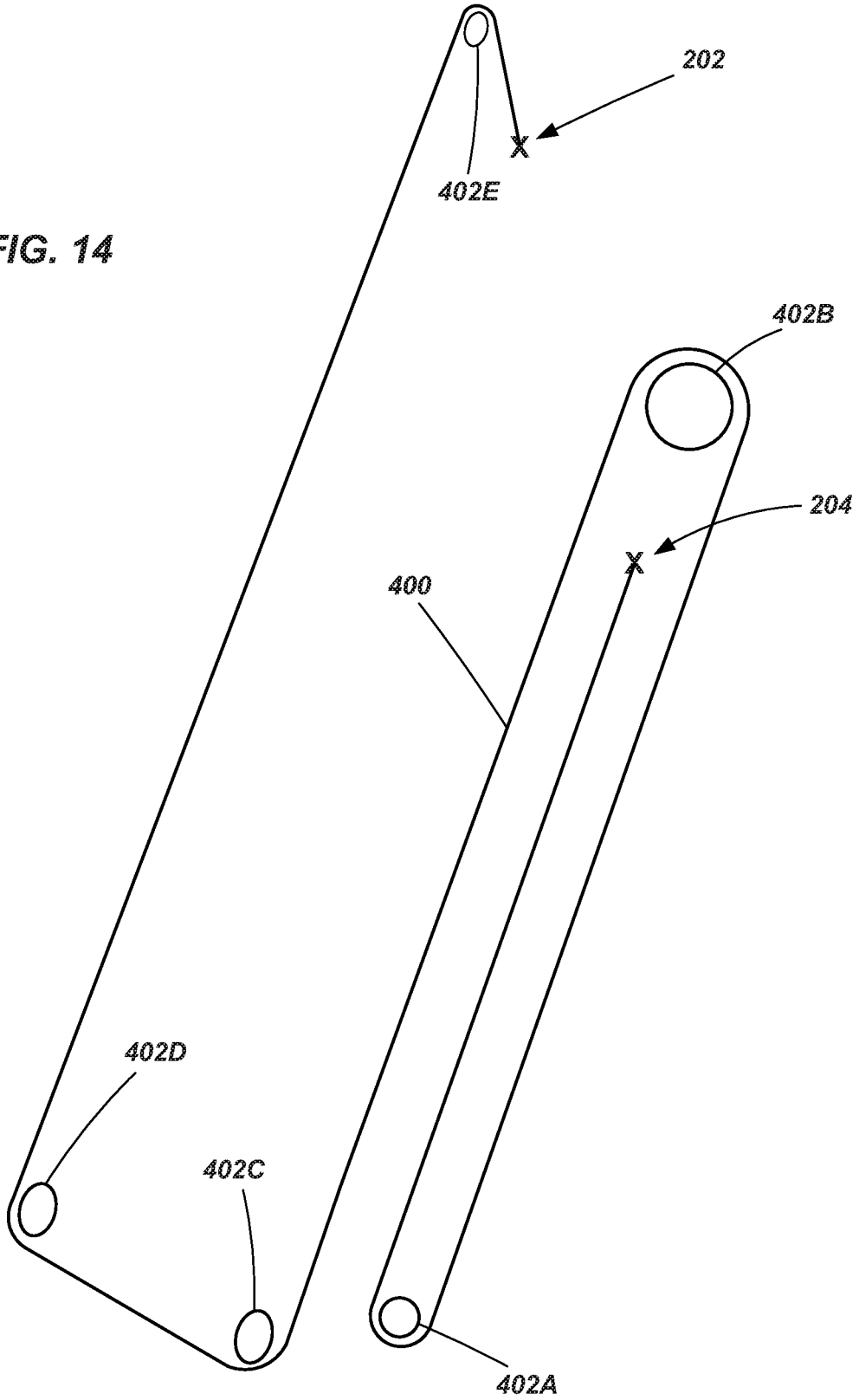
FIG. 14 is a schematic showing the path of the rope or cable used in the positioning system shown in FIGS. 9-13.

Referring briefly to FIG. 14, a schematic is shown of the rope 400 and pulleys (402A-402E) for purposes of clarity. Again, the rope 400 has one end fixed to an upper portion of the base section 204, passes through a first pulley 402A coupled with the fly section 202, through a second pulley 402B coupled with an upper portion of the base section 204, through a third pulley 402C coupled with a lower portion of the base section 204, through a fourth pulley 402D coupled with a lower portion of the base section 204, through a fifth pulley 402E coupled with an upper portion of the fly section 202, and has the second end fixed to the fly section 202.

Stated another way, in the arrangement illustrated in FIGS. 9-14, there are six sections of the rope 400. The first section extends between the fixed end of the rope (near the second pulley 402B) to the first pulley 402A. The second section extends from the first pulley 402A to the second pulley 402B. The third section extends from the second pulley 402B down to the third pulley 402C. The fourth section extends from the third pulley 402C to the fourth pulley 402D. The fifth section extends from the fourth pulley 402D to the fifth pulley 402E. The sixth section extends from the fifth pulley 402E to a fixed end (coupled with the fly section).

The first two sections, and a portion of the third section of rope 400 may be positioned to lie inside a channel defined by a rail of the fly section 202. The third section may partially lie within the same channel, and partially extend outside of the channel (e.g., along a front or side surface of the rail of the fly section) as it extends to the third pulley 402C. The fourth section extends along the front face of the ladder (i.e., the base section 204) and the fifth section extends up the ladder in front of the rungs of the ladder 100.

To raise or alter the position of the fly section 202 relative to the base section 204, a user applies a downward or an upward force to the third section of rope (between the second and third pulleys 402B and 402C) depending on whether they want to lower or raise the fly section 202. In an example where the fly section 202 is raised relative to the base section 204, a user would pull down on the third section of rope. In response to the downward force applied to the third section of rope, the first section and second section of rope would shorten (the first pulley 402A being displaced with the fly section closer to the second pulley 402B), while the fifth section of rope is lengthened. The third section, fourth section and sixth section of rope would remain the same length. In lowering the fly section 202, a user may initially pull downwards on the third section of rope in order to disengage the rung locks, and then apply a force to the third section of the rope so as to allow it to be displaced upwards in a controlled manner. Once the fly section 202 is at a desired height or position relative to the base section 204, the user may manipulate the rope to effect engagement of the rung lock as will be appreciated by those of ordinary skill in the art.

The use of a single rope 400 that has both ends fixed to the ladder 200 enables the ladder 200 to be adjusted without a loose end potentially becoming tangled in the ladder 200, tripped on by a user, dragging on the ground (causing undue wear to the rope) or getting caught in other hazards in a working environment. Additionally, using such an arrangement of pulleys 402A-402E may enable the fly section to be raised and lowered, relative to the base section, with reduced force or effort provided by a user. It is noted that the rope 400 maintains its tautness between its first end and its second end regardless of where the fly section 202 is positioned relative to the base section 204. In other words, repositioning the fly section 204 relative to the base section neither creates or removes slack in the rope 400.

In conjunction with the positioning system to the rope and pulley system, a fall arrest device may be utilized. For example, a mechanical climbing device 410 (also referred to as an ascender) may be coupled to the fifth section of rope (which m ay be substantially centered between the rails of the ladder 200, positioned in front of the rungs, and extends between the fourth and fifth pulleys 402D and 402E). A user may connect the ascender 410 to a harness that they are wearing and the ascender 410 is configured to permit upward climbing of the ladder (and "sliding" of the ascender 410 along the fifth section of rope 400) without hindrance, but acts as a safety brake, stopping the user from falling to the ground, in the event that a user slips and falls from the ladder. In order to descend, a user may be required to maintain activation of a lever or other 412 actuator device on the ascender 410 such that the ascender "releases" its grip on the rope 400 and "slides" downward along the fifth section of rope 400 while a user climbs back down the ladder 200. If a user slips off of a rung while descending the ladder, release the lever 410 may cause the ascender 410 to again engage with and bite the rope, preventing the user from falling further.

A variety of different devices may be used as the ascender 410. For example, ascenders are known mountain climbing devices and are available from companies such as Petzl®. Additionally, non-limiting examples of devices may be found in U.S. Pat. No. 5,156,240 to Ostrobrod (issued Oct. 20, 1992) and U.S. Pat. No. 5,850,893 to Hede et al. (issued Dec. 22, 1998), as well as U.S. Patent Publication No. 2011/0073417 to Chaumontet et al. (published Mar. 31, 2011), the disclosures of which are each incorporated by reference herein in their entireties. It is also noted that the fall arrest system, including a rope extending between upper and lower portions of a ladder and an ascender type device, may be incorporated with other types of ladders, including straight (non-extension) ladders and combination ladders.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A ladder comprising:

a single base section having a first pair of rails and a first plurality of rungs extending between laterally inner surfaces of the first pair of rails and coupled to the first pair of rails;

a single fly section slidably coupled to the base section, the fly section having a second pair of rails and a second plurality of rungs extending between laterally inner surfaces of the second pair of rails and coupled to the second pair of rails;

a rope and pulley system comprising:

a rope having a first end coupled to the base section and a second end coupled to the fly section;

a plurality of pulleys configured so that a first section of the rope extends along a laterally outer surface of a first rail of the second pair of rails and positioned such that the first section of rope is on a side of the first rail opposite the second plurality of rungs, the plurality of pulleys being further configured so that another section of the rope extends from a lower portion of the base section to an upper portion of the fly section while being laterally positioned between the second pair of rails and spaced away from each of the second pair of rails.

2. The ladder of claim 1, wherein the another section of rope is substantially centered along both the base section and the fly section.

3. The ladder of claim 1, wherein the plurality of pulleys includes at least one pulley coupled with the fly section and at least one other pulley coupled with the base section.

4. The ladder of claim 1, wherein the plurality of pulleys includes at least two pulleys coupled with the fly section and at least two other pulleys coupled with the base section.

5. The ladder of claim 1, wherein the first end of the rope is coupled with a bracket fixed to the base section, the bracket extending at least partially around one rail of the second pair of rails.

6. The ladder of claim 1, wherein the first section of the rope extends from the first end through a first pulley of the plurality of pulleys, the first pulley being coupled with the fly section, and wherein the rope includes:

a second section of rope extending from the first pulley to a second pulley, the second pulley being coupled with the base section at a location adjacent the first end of the rope;

a third section of rope extending from the second pulley to a third pulley, the third pulley being coupled to a lower portion of the base section adjacent a rail of the first pair of rails;

a fourth section of rope extending from the third pulley to a fourth pulley, the fourth pulley being coupled to the base section at a location between the first pair of rails; and wherein the another section of rope is a fifth section extending from the fourth pulley upwards between the first pair of rails.

7. The ladder of claim 6, wherein the fifth section of rope extends to a fifth pulley that is coupled with the fly section between the second pair of rails.

8. The ladder of claim 7, wherein the rope includes a sixth section extending from the fifth pulley to the second end of the rope.

9. The ladder of claim 7, wherein the fifth section of rope is positioned in front of the first plurality of rungs and the second plurality of rungs when the ladder is in an orientation of intended use.

10. The ladder of claim 6, wherein the rope and plurality of pulleys are arranged such that a downward force applied to third section of rope urges the fly section upward relative to the base section.

11. The ladder of claim 1, further comprising an ascender device coupled to the another section of rope, the ascender device configured to be coupled with a harness worn by a user of the ladder.

12. The ladder of claim 11, wherein the ascender device is configured to slide freely upwards along the rope without further manipulation by a user when the ladder is in an orientation of intended use.

13. The ladder of claim 12, wherein the ascender device is configured to inhibit downward movement along the rope.

14. The ladder of claim 1, further comprising a pair of adjustable support members coupled with the base section, the pair of adjustable support members being configured to be adjusted relative to a pair of rails of the base section in at least one of height and width relative to the pair of rails.

15. The ladder of claim 1, wherein the fly section includes a pair of rails, and wherein the ladder further comprises a pair of hooks, each hook being positioned adjacent an upper end of an associated rail of the pair of rails.

16. The ladder of claim 15, further comprising a securing apparatus coupled adjacent the upper end of the pair rails, the securing apparatus including a pair of spaced apart engaging members, each engagement member being pivotally coupled with an associated rail of the second pair of rails.

17. A ladder comprising:

a single base section comprising a first pair of spaced apart rails and a first plurality of rungs extending between laterally inner surfaces of the first pair of rails and coupled with the first pair of spaced apart rails;

a single fly section slidably coupled to the base section, the fly section including a second pair of spaced apart rails and a second plurality of rungs extending between laterally inner surfaces of the second pair of rails and coupled with the second pair of spaced apart rails;

a rope and pulley system comprising:

a rope having a first end fixed to the base section adjacent a laterally outer surface of a first rail of the first pair of rails and positioned such that the first end is on a side of the first rail opposite the second plurality of rungs, and a second end fixed to the fly section between said second pair of spaced apart rails of said fly section, the rope extending continually and sequentially:

i) from the first end through a first pulley coupled with the fly section, ii) through a second pulley coupled with the base section, iii) through a third pulley coupled with the base section, iv) through a fourth pulley coupled with the base section, v) through a fifth pulley coupled with the fly section, and vi) to the second end.

18. The ladder of claim 17, wherein the second pulley is positioned adjacent the first end of the rope.

19. The ladder of claim 18, wherein the third and fourth pulleys are positioned along a lower portion of the base section when the ladder is in an orientation of intended use.

20. The ladder of claim 19, wherein the fifth pulley is positioned along an upper portion of the fly section.

21. The ladder of claim 17, further comprising an ascender device coupled with the rope at a location between the fourth and fifth pulleys.

22. The ladder of claim 21, wherein the ascender device is configured to slide freely upwards along the rope without further manipulation by a user when the ladder is in an orientation of intended use, and to inhibit downward movement along the rope.

23. The ladder of claim 17, further comprising a pair of adjustable support members, support member being coupled with an associated rail of the first pair of spaced apart rails, the pair of adjustable support members being configured to be adjusted relative to the first pair of spaced apart rails of the base section in at least one of height and width.

24. The ladder of claim 17, further comprising a pair of hooks, each hook being positioned adjacent an upper end of an associated rail of the second pair of spaced apart rails.

25. The ladder of claim 24, further comprising a securing apparatus coupled adjacent the upper end of the second pair of spaced apart rails, the securing apparatus including a pair of spaced apart engaging members, each engagement member being pivotally coupled with an associated rail of the pair of rails.

* * * * *